US012729908B2

(12) United States Patent
Thakkar et al.

(10) Patent No.: US 12,729,908 B2
(45) Date of Patent: Sep. 8, 2026

(54) APPARATUS AND PROCESS FOR IMPROVED ARGON RECOVERY

(71) Applicant: Air Products and Chemicals, Inc., Allentown, PA (US)

(72) Inventors: Jay A. Thakkar, Allentown, PA (US); Alan D. Berger, Fogelsville, PA (US); Donn Michael Herron, Fogelsville, PA (US)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 222 days.

(21) Appl. No.: 18/627,490

(22) Filed: Apr. 5, 2024

(65) Prior Publication Data

US 2025/0314424 A1 Oct. 9, 2025

(51) Int. Cl.
*F25J 3/04* (2006.01)

(52) U.S. Cl.
CPC ..... *F25J 3/04678* (2013.01); *F25J 3/04018* (2013.01); *F25J 3/04321* (2013.01); *F25J 3/04412* (2013.01); *F25J 3/04969* (2013.01); *F25J 2200/06* (2013.01); *F25J 2200/32* (2013.01); *F25J 2205/02* (2013.01); *F25J 2210/04* (2013.01); *F25J 2210/40* (2013.01);
(Continued)

(58) Field of Classification Search
CPC .... F25J 3/02; F25J 3/04; F25J 3/04018; F25J 3/04187; F25J 3/04284; F25J 3/04303; F25J 3/04321; F25J 3/04406; F25J 3/04412; F25J 3/04466; F25J 3/04648; F25J 3/04721; F25J 3/04727; F25J 3/048; F25J 3/04806; F25J 5/005; F25J 2200/04; F25J 2200/06; F25J 2200/34; F25J 2200/70; F25J 2200/78; F25J 2205/02; F25J 2205/40; F25J 2210/04; F25J 2210/40; F25J 2215/42; F25J 2215/50; F25J 2215/58; F25J 2230/40; F25J 2245/50; F25J 2250/50; F25J 2250/52; F25J 2250/58; F25J 2270/50; F25J 2245/02; F25J 2245/40; F25J 2240/48
See application file for complete search history.

(56) References Cited

U.S. PATENT DOCUMENTS 4,022,030 A 5/1977 Brugerolle
4,822,395 A 4/1989 Cheung
(Continued)

FOREIGN PATENT DOCUMENTS

DE 10341552 A1 10/2004
FR 2839548 A1 11/2003
(Continued)

*Primary Examiner* — Frantz F Jules
*Assistant Examiner* — Devon Moore
(74) *Attorney, Agent, or Firm* — Matthew R. Weaver

(57) ABSTRACT

An apparatus and process for argon recovery can be configured so that an argon-enriched stream including oxygen therein can be recycled to a column for air separation and subsequent argon separation to provide improved argon recovery with reduced power. The recycling of this argon-enriched stream can be provided such that there is sufficient nitrogen within the column to facilitate separation of argon from oxygen within the column so additional argon that can be provided via the recycling can be separated and purified instead of being output as a waste stream or otherwise lost.

6 Claims, 12 Drawing Sheets

(52) U.S. Cl.
CPC ..... *F25J 2215/42* (2013.01); *F25J 2215/50* (2013.01); *F25J 2215/58* (2013.01); *F25J 2230/40* (2013.01); *F25J 2245/50* (2013.01); *F25J 2270/50* (2013.01); *F25J 2290/80* (2013.01)

(56) References Cited

U.S. PATENT DOCUMENTS

| | | | | |
|---|---|---|---|---|
| 5,305,611 | A | 4/1994 | Howard | |
| 8,899,075 | B2 * | 12/2014 | Howard | F25J 3/04024 62/646 |
| 11,512,897 | B2 * | 11/2022 | Herron | F25J 3/04672 |
| 11,933,539 | B2 * | 3/2024 | Xu | F25J 3/04303 |
| 2013/0019634 | A1 * | 1/2013 | Howard | F25J 3/04303 62/643 |
| 2019/0331417 | A1 | 10/2019 | Kromer et al. | |
| 2019/0331418 | A1 | 10/2019 | Prosser et al. | |
| 2019/0331419 | A1 | 10/2019 | Handley et al. | |

FOREIGN PATENT DOCUMENTS

| | | | |
|---|---|---|---|
| JP | 3414947 | B2 | 6/2003 |
| WO | 2014099848 | A2 | 6/2014 |
| WO | 2021078405 | A1 | 4/2020 |
| WO | 2020169257 | A1 | 8/2020 |
| WO | 2020244801 | A1 | 12/2020 |

* cited by examiner

APPARATUS AND PROCESS FOR IMPROVED ARGON RECOVERY

FIELD OF THE INVENTION

The present innovation relates to processes and apparatuses for recovery of argon from a feed (e.g. a feed of air, etc.).

BACKGROUND OF THE INVENTION

Air separation processing has been utilized to separate air into different constituent flows of fluid (e.g. nitrogen, oxygen, etc.). Examples of systems that were developed in conjunction with air separation processing include U.S. Pat. Nos. 4,022,030, 4,822,395, International Patent Publication Nos. WO2020/169257, WO2020/244801, WO 2021/078405 and U.S. Pat. App. Pub. Nos. 2019/0331417, 2019/0331418, and 2019/0331419.

Some manufacturers may require the air separation plant in their facility to supply high purity argon as well as nitrogen. Some examples of argon stream processing can be appreciated from U.S. Pat. No. 5,305,611, International Patent Publication No. 2014/099848, French Patent Publication No. FR 2839548, German Patent Publication No. DE 10341552A1, and Japanese Patent No. JP 3414947.

SUMMARY OF THE INVENTION

Some air separation processes that may utilize or produce argon can incur substantial cost in terms of power needed for processing to obtain incremental recovery of argon from air. For example, a condenser of an argon column may utilize boiling of a crude liquid oxygen stream output from a high pressure column and subsequently vent that boiled stream. Also, we have determined that methods for reducing this incremental power cost often have drawbacks. For example, subcooling the crude liquid oxygen stream may offer a theoretical power savings, but doing so is often impractical due to the increased pressure drop required to transfer the crude liquid oxygen stream through the subcooler and through the large change in elevation that can be required by the column system.

We have determined that an improved process can be provided that can increase argon recovery without significantly increasing power needed for operation of the system by avoiding or reducing venting of such a stream. Instead, embodiments can be configured so that at least a portion of this stream is recycled for providing an improved argon recovery without incurring substantial increased power requirements for air separation processing. For example, some embodiments can utilize a condenser driven by vaporization of crude liquid oxygen (CLOX) to provide improved argon recovery by outputting the at least partially vaporized CLOX so that at least a portion of the at least partially vaporized CLOX is recycled to be mixed with fresh feed gas (e.g. air or other process gas) being fed to a column assembly for air separation. Another portion of the at least partially vaporized CLOX that can be entirely liquid, entirely vapor, or be a 2 phase fluid that includes liquid and vapor can be feedable to a low pressure column. A splitting mechanism can be positioned to provide splitting of the at least partially vaporized CLOX stream.

Embodiments can provide improved operational efficiency via the recycling by increasing an argon content within the feed fed to the column assembly of the air separation process such that there is still sufficient nitrogen in the feed for providing boilup and/or reflux for a low pressure column to facilitate driving the separation of oxygen and argon in the column assembly of the air separation process. Such recycling can be configured to provide an improved argon recovery without adjusting power requirements for the processing (or by keeping any change in power to be a relatively minor increase). Some embodiments can be employed simply and cost effectively. For instance, some embodiments can be provided so retrofitting of a pre-existing facility that performs air separation with argon recovery may only need relatively small changes to pre-existing process flows to permit the pre-existing conventional systems to be retrofit to an embodiment of this new process and/or apparatus so that improved argon recovery can be obtained. In many such scenarios, such embodiments can provide improved argon recovery without large capital costs being incurred.

In a first aspect, embodiments of a process for separation of a feed gas comprising oxygen, nitrogen, and argon can be provided. Embodiments of the process can include outputting an oxygen-enriched stream from a first column of an air separation unit (ASU) wherein the first column operates at a pressure that is greater than a pressure of a second column of the ASU. The process can also include at least one of:

(a) passing at least a portion of the oxygen-enriched stream output from the first column through at least one of:
  (i) a reboiler-condenser of a third column to facilitate condensation of an argon-rich stream outputtable from the third column and outputting of the portion of the oxygen-enriched stream as a recyclable oxygen-enriched stream that is gaseous or is a combination of gas and liquid, and/or
  (ii) a recyclable oxygen-enriched vapor stream formation device positioned upstream of the reboiler-condenser of the third column so a vaporized portion of the oxygen-enriched stream output from the first column is output from the recyclable oxygen-enriched vapor stream formation device as a recyclable oxygen-enriched vapor stream that is gaseous; and
(b) outputting a recyclable oxygen-enriched stream from the second column.

Embodiments of the process can include only option (a)(i), only option (a)(ii), a combination of options a(i) and a(ii), only option (b), all of (a)(i), (a)(iii), and (b), or any other possible combination of options a(i), a(ii), and (b). Embodiments of the process can also include other steps or features.

For example, the process can also include (1) passing the recyclable oxygen-enriched stream output from the second column and/or (2) passing at least a portion of the recyclable oxygen-enriched stream output from the reboiler-condenser of the of the third column and/or (3) passing at least a portion of the recyclable oxygen-enriched vapor stream that is gaseous output from the recyclable oxygen-enriched vapor stream formation device so the fluid is passed upstream of the first column, second column, and third column, for mixing with a feed stream and subsequently being fed to the first column and/or the second column of the ASU. Such passing of recyclable oxygen-enriched stream can include all of options (1), (2), and (3), only one of these options, or a combination of two of these options (e.g. options (2) and (3), options (1) and (3), options (1) and (2), etc.) so that the fluid is passed upstream of the first column, second column, and third column for mixing with a feed stream and subsequently being fed to the first column and/or the second column of the ASU.

In some embodiments, such passing of the fluid upstream of the first, second and third columns can occur such that the fluid is passed upstream of a pre-purification unit (PPU), a feed compressor that can be positioned to compress a fresh feed of air, or being passed upstream to a stage of a feed compressor for being mixed with fresh air being compressed therein. Embodiments of the process can also include yet other steps or features as well.

For example, in a second aspect, the process can also include splitting the recyclable oxygen-enriched vapor stream that is gaseous output from the recyclable oxygen-enriched vapor stream formation device that is upstream of the reboiler-condenser of the third column into a first portion and a second portion so that the first portion of the recyclable oxygen-enriched vapor stream is passable upstream of the first column, second column, and third column, for mixing with the feed stream and subsequently being fed to the first column and/or the second column of the ASU and the second portion of the recyclable oxygen-enriched vapor stream is passable to the second column.

As another example, in a third aspect, the process can include splitting the recyclable oxygen-enriched stream output from the reboiler-condenser of the third column to form a first recycle stream for passing upstream of the first column, second column, and third column, for mixing with the feed stream and also a second column feed stream for feeding to the second column. In some embodiments, the splitting can be performed via at least one phase separator.

In some embodiments, the process can also include passing the second column feed stream to the second column at a location above a location at which an argon-enriched stream is output from the second column for feeding to the third column.

In a fourth aspect, the process can include the passing of the at least a portion of the oxygen-enriched stream output from the first column through (i) the reboiler-condenser of the third column to facilitate condensation of the argon-rich stream outputtable from the third column and outputting of the portion of the oxygen-enriched stream as the recyclable oxygen-enriched stream that is gaseous or is a combination of gas and liquid and (ii) the recyclable oxygen-enriched vapor stream formation device so the vaporized portion of the oxygen-enriched stream output from the first column is output from the recyclable oxygen-enriched vapor stream formation device as the recyclable oxygen-enriched vapor stream that is gaseous. Embodiments of the process can also include the outputting of the recyclable oxygen-enriched stream from the second column. Also, the oxygen-enriched stream output from the second column, the at least a portion of the recyclable oxygen-enriched stream output from the reboiler-condenser of the of the third column and the at least a portion of the recyclable oxygen-enriched vapor stream that is gaseous output from the recyclable oxygen-enriched vapor stream formation device can be passed upstream of the first column, second column, and third column, for mixing with a feed stream and subsequently being fed to the first column and/or the second column of the ASU.

In a fifth aspect, the process can include the passing of the at least a portion of the oxygen-enriched stream output from the first column through (i) the reboiler-condenser of the third column to facilitate condensation of the argon-rich stream outputtable from the third column and outputting of the portion of the oxygen-enriched stream as the recyclable oxygen-enriched stream that is gaseous or is a combination of gas and liquid or (ii) the recyclable oxygen-enriched vapor stream formation device so the vaporized portion of the oxygen-enriched stream output from the first column is output from the recyclable oxygen-enriched vapor stream formation device as the recyclable oxygen-enriched vapor stream that is gaseous.

In a sixth aspect, the process can include compressing the feed stream that includes air and/or industrial gas after the feed stream is mixed with the recyclable oxygen-enriched stream output from the second column, and/or the at least a portion of the recyclable oxygen-enriched stream output from the reboiler-condenser of the of the third column and/or the at least a portion of the recyclable oxygen-enriched vapor stream that is gaseous output from the recyclable oxygen-enriched vapor stream formation device.

In a seventh aspect, the process of the first aspect can include one or more features from the second aspect, third aspect, fourth aspect, fifth aspect, and/or sixth aspect. Embodiments of the process can also include other features or process steps. For instance, examples of such additional features or process steps that can be utilized in different embodiments of the process can be appreciated from the exemplary embodiments discussed herein.

In an eighth aspect, an apparatus for argon recovery is provided. Embodiments of the apparatus can be configured to utilize an embodiment of the process for separation of a feed gas comprising oxygen, nitrogen, and argon. Embodiments of the apparatus for argon recovery can include a first column and a second column wherein the first column can be operatable at a pressure that is higher than a pressure at which the second column is operatable. The apparatus can also include a third column positioned to receive an argon-enriched stream outputtable from the second column. The apparatus can also include at least one of:

(i) a reboiler-condenser of the third column positioned and configured to receive a portion of an oxygen-enriched stream output from the first column to at least partially condense an argon-rich stream output from the third column wherein the reboiler-condenser of the third column can be positioned and configured to at least partially vaporize the portion of the oxygen-enriched stream output from the first column to output a recyclable oxygen-enriched stream so that at least a portion of the recyclable oxygen-enriched stream is recyclable upstream of the first column, the second column, and third column for being mixed with a feed stream for forming a compressed feed stream to feed to the first column and/or the second column to form the argon-enriched stream outputtable from the second column, and/or (ii) a recyclable oxygen-enriched vapor stream formation device positioned upstream of the reboiler-condenser of the third column so a vaporized portion of the oxygen-enriched stream output from the first column is output from the recyclable oxygen-enriched vapor stream formation device as a recyclable oxygen-enriched vapor stream that is gaseous so that at least a portion of the recyclable oxygen-enriched vapor stream is recyclable upstream of the first column, the second column, and third column for being mixed with the feed stream for forming the compressed feed stream to feed to the first column and/or the second column to form the argon-enriched stream outputtable from the second column; and/or (iii) the second column configured to output a recyclable oxygen-enriched stream for being mixed with the feed stream for forming the compressed feed stream to feed to the first column and/or the second column to form the argon-enriched stream outputtable from the second column.

Some embodiments of the apparatus may only include one of items (i), (ii), and (iii). Other embodiments can utilize all of items (i), (ii), and (iii). Yet other embodiments can utilize a combination of two of items (i), (ii), and (iii) (e.g. items (i) and (ii), items (iii) and (i), items (ii) and (iii), etc.). Embodiments of the apparatus can also include other features or process elements.

For instance, in a ninth aspect, the apparatus can include a splitting mechanism positioned to receive the recyclable oxygen-enriched stream outputtable from the reboiler-condenser of the third column to split the recyclable oxygen-enriched stream into: (a) a first recyclable stream to recycle at least a portion of the first recycle stream upstream of the first column, second column, and third column for being mixed with the feed stream for forming the compressed feed stream to feed to the first column and/or the second column to form the argon-enriched stream outputtable from the second column and (b) a second column feed stream for feeding the second column feed stream to the second column. In some embodiments, the splitting mechanism can include at least one phase separator or be configured as a separation mechanism. In other embodiments, the splitting mechanism can have another type of configuration.

In a tenth aspect, the apparatus can also include a compression system positioned to compress the feed stream and the at least a portion of the recyclable oxygen-enriched stream that is recyclable upstream of the first column, second column, and third column. The compression system can be positioned upstream of the first column, second column, and third column. For example, the compression system can include a feed compressor or at least one feed compressor.

In an eleventh aspect, the apparatus can also include a first heat exchanger positioned downstream of the compression system to cool the compressed feed stream before the compressed feed stream is fed to the first column and/or the second column to form the argon-enriched stream that is outputtable from the second column. In some embodiments, the first heat exchanger can be positioned between a compression system that forms the compressed feed stream and the first, second, and third columns. The first heat exchanger can also receive one or more streams from the first, second, and third columns for use as one or more cooling mediums for use in cooling the compressed feed stream before the compressed feed stream is fed to the first column and/or the second column.

The compressed feed stream can also be split into two or more feed streams. In some configurations, the compressed feed stream can be split into one or more other portions of the feed stream to undergo further compression before those portions are passed through the first heat exchanger to be cooled therein for subsequently being fed to the first column and/or second column.

In a twelfth aspect, the apparatus can be configured to include the reboiler-condenser of the third column positioned and be configured to receive the portion of the oxygen-enriched stream output from the first column to at least partially condense the argon-rich stream output from the third column. The reboiler-condenser of the third column can be positioned and configured to at least partially vaporize the portion of the oxygen-enriched stream output from the first column to output the recyclable oxygen-enriched stream so that at least a portion of the recyclable oxygen-enriched stream is recyclable upstream of the first column, the second column, and third column for being mixed with the feed stream for forming the compressed feed stream to feed to the first column and/or the second column to form the argon-enriched stream outputtable from the second column.

In a thirteenth aspect, the apparatus can include the recyclable oxygen-enriched vapor stream formation device positioned upstream of the reboiler-condenser of the third column so the vaporized portion of the oxygen-enriched stream output from the first column is output from the recyclable oxygen-enriched vapor stream formation device as the recyclable oxygen-enriched vapor stream that is gaseous so that at least a portion of the recyclable oxygen-enriched vapor stream is recyclable upstream of the first column, the second column, and third column for being mixed with the feed stream for forming the compressed feed stream to feed to the first column and/or the second column to form the argon-enriched stream outputtable from the second column.

In a fourteenth aspect, the apparatus can be configured so that the portion of the oxygen-enriched stream output from the first column that is passable to the reboiler-condenser of the third column is a first portion of the oxygen-enriched stream outputtable from the first column. The first column can be connected to the second column such that a second portion of the oxygen-enriched stream outputtable from the first column is feedable to the second column and the second column can be configured to output a recyclable oxygen-enriched stream for being mixed with the feed stream for forming the compressed feed stream to feed to the first column and/or the second column to form the argon-enriched stream outputtable from the second column.

In a fifteenth aspect, the apparatus of the eighth aspect can include one or more features of the ninth aspect, tenth aspect, eleventh aspect, twelfth aspect, thirteen aspect and/or fourteenth aspect. Embodiments can also include other features or elements (e.g. automated process control elements, sensors, at least one controller, etc.). For instance, examples of such additional features or process elements that can be utilized in different embodiments of the apparatus can be appreciated from the exemplary embodiments of the process discussed herein.

In a sixteenth aspect, a method of retrofitting an air separation unit (ASU) is provided. The ASU can have a first column, a second column, and a third column. The method of retrofitting can include one or more of:

(i) positioning a splitting mechanism between a reboiler-condenser of the third column and the second column so that the reboiler-condenser of the third column outputs a partially vaporized portion of an oxygen-enriched stream output from the first column as a recyclable oxygen-enriched stream for feeding to the splitting mechanism so that a first portion of the recyclable oxygen-enriched stream is recyclable upstream of the first column, second column, and third column for being mixed with a feed stream for forming a compressed feed stream to feed to the first column and/or the second column to form an argon-enriched stream outputtable from the second column wherein the argon-enriched stream outputtable from the second column can be feedable to the third column for forming an argon-rich vapor that is at least partially condensable via the reboiler-condenser of the third column; and/or (ii) connecting a recyclable oxygen-enriched vapor stream formation device positioned upstream of the reboiler-condenser of the third column so that the recyclable oxygen-enriched vapor stream formation device is fluidly connected at a location upstream of the first column, the second column, and third column such that a vaporized portion of the oxygen-enriched stream output from the first column is outputtable from the recyclable oxygen-enriched vapor stream formation device as a recyclable oxygen-enriched vapor stream that is gaseous so that at least a portion of the recyclable oxygen-enriched vapor stream is recyclable upstream of the first column, the second column, and third column for being mixed with the feed stream for forming the compressed feed stream to feed to the first column and/or the second column to form the argon-enriched stream outputtable from the second column.

In some embodiments, the method of retrofitting can include element (i) or element (ii). In other embodiments, the method can include both elements (i) and (ii). Embodiments of the method can also include other steps or features.

In some embodiments, the splitting mechanism can include a phase separator or be configured as a separation mechanism. In other embodiments, the splitting mechanism can include an arrangement of valves and/or conduit segments. In yet other embodiments, the splitting mechanism can include a combination of conduit segments and at least one phase separator. Other embodiments can utilize other configurations of a splitting mechanism as well.

For example, in a seventeenth aspect, the retrofitting method can also include positioning a recycle stream split conduit between (i) a conduit through which the first portion of the recyclable oxygen-enriched stream is passable to be recyclable upstream of the first column, second column, and third column and (ii) a conduit through which a second portion of the recyclable oxygen-enriched stream is passable for being fed to the second column as a second column feed stream so that some of the first portion of the recyclable oxygen-enriched stream is passable to the second portion of the recyclable oxygen-enriched stream for being fed to the second column. The first portion of the recyclable oxygen-enriched stream can be comprised of gas and the second portion of the recyclable oxygen-enriched stream can be comprised of liquid.

In some embodiments, the retrofitting method can be implemented so that after the retrofitting is completed, the ASU is modified to be an embodiment of the apparatus for argon recovery that can be configured to implement an embodiment of the process for separation of a feed gas comprising oxygen, nitrogen, and argon.

It should be appreciated that embodiments of the process and apparatus can utilize various conduit arrangements and process control elements. The embodiments may utilize sensors (e.g., pressure sensors, temperature sensors, flow rate sensors, concentration sensors, etc.), controllers, valves, piping, and other process control elements. Some embodiments can utilize an automated process control system and/or a distributed control system (DCS), for example. Various different conduit arrangements and process control systems can be utilized to meet a particular set of design criteria.

Other details, objects, and advantages of our apparatus for argon recovery, process for argon recovery, fand methods of making and using the same will become apparent as the following description of certain exemplary embodiments thereof proceeds.

BRIEF DESCRIPTION OF THE DRAWINGS

Exemplary embodiments of our apparatus for argon recovery, process for argon recovery, and methods of making and using the same are shown in the drawings included herewith. It should be understood that like reference characters used in the drawings may identify like components.

DETAILED DESCRIPTION OF THE INVENTION

Figure 1:
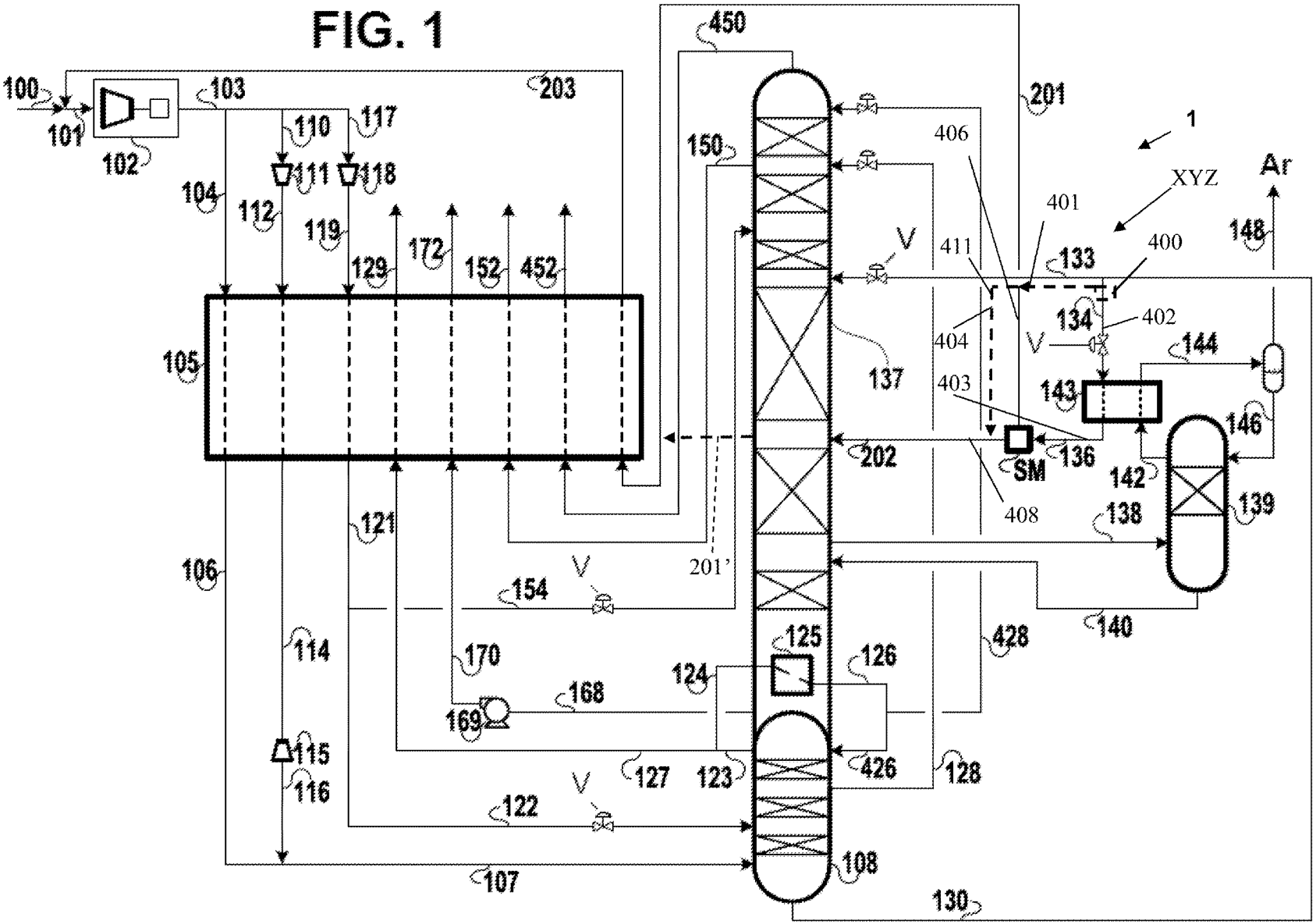
FIG. 1 is a block diagram of a first exemplary embodiment of an apparatus for argon recovery. An exemplary embodiment of a process for argon recovery can also be appreciated from FIG. 1.

Referring to FIGS. 1-12, an apparatus 1 for argon recovery can include an air separation unit (ASU). The ASU can include a compression system 102 that can compress a feed gas 101 to output a compressed feed gas stream 103 at a pre-selected feed pressure or at a pressure within a pre-selected feed pressure range. The feed gas that is compressed by the compression system can include argon (Ar), nitrogen ($N_2$) and oxygen ($O_2$), as well as other constituents (e.g. carbon dioxide ($CO_2$), water ($H_2O$), etc.). For example, the feed gas 101 that is compressed can include a feed stream 100 of air or a feed stream 100 of gas from a plant process unit that can be fed to the compression system 102. After starting-up of the ASU, the feed gas 101 can also include an argon-enriched recycle stream 203 that can be output from a reboiler-condenser 143 of an argon column 139 of the ASU and fed to the compression system 102 and/or is mixed with the feed stream 100 prior to being fed to the compression system 102.

In some embodiments, the recyclable argon-enriched recycle stream 203 can be formed and routed to provide between 0.1 vol % to 15 vol %, between 2 vol % to 10 vol %, or between 3 vol % and 9 vol % of fluid of the compressed feed gas stream 103 fed to the column assembly of the ASU (e.g. fed to the first and second columns 108 and 137 of the ASU). In some embodiments, the recyclable argon-enriched recycle stream 203 can include 0.9 vol % to 5 vol % argon, 20 vol % to 40 vol % oxygen, and 55 vol % to 79.2 vol % nitrogen. For example, in some embodiments, the recyclable argon-enriched recycle stream 203 can include 0.9 vol % to 4 vol % argon, 25 vol % to 35 vol % oxygen and 61 vol % to 74.1 vol % nitrogen or 1 vol % to 3 vol % argon, 26 vol % to 34 vol % oxygen, and 63 vol % to 73 vol % nitrogen. Other embodiments may utilize other concentration ranges as well.

The compression system 102 can also include a purification unit for purification of the feed after it is compressed. For example, the purification unit can include a pre-purification unit (PPU) that includes one or more adsorbers for removal of undesired impurities. For instance, the purification unit can remove undesired feed constituents that may have undesired boiling points or present other undesired processing difficulties. The purification unit can remove, for example, $CO_2$, carbon monoxide (CO), hydrogen ($H_2$), methane ($CH_4$) and/or water ($H_2O$) from the feed, for example.

The compressed feed gas stream 103 output from the compression system 102 can be a purified feed gas stream that has impurities removed from the feed so that the impurities are below pre-selected constituent thresholds or are entirely removed from the compressed feed gas stream 103 before the compressed feed gas stream 103 is passed to a first heat exchanger 105. In some embodiments, the compressed feed gas stream 103 can include nitrogen ($N_2$) within a pre-selected nitrogen concentration range, argon (Ar) within a pre-selected argon concentration range, and $O_2$ within a pre-selected oxygen concentration range. Initially, the pre-selected $N_2$ concentration range can be, for example, 75-80 volume percent (vol %) of the feed gas stream 103, the pre-selected argon concentration range can be 0.8-4.2 vol % of the feed gas stream 103, and the pre-selected $O_2$ concentration range can be 16-25 vol % of the feed gas stream 103, example.

After start-up and the recycling of the argon-enriched recycle stream 203, the feed gas stream 103 can have higher concentrations of argon and oxygen and a lower concentration of nitrogen. For example, after the apparatus has run for a period of time and the argon-enriched recycle stream 203 has been in use, the concentration of argon (Ar) within the compressed feed stream 103 can be a content of argon that is greater than a content of argon within air. For example, the content of argon within the compressed feed stream 103 that has the argon-enriched recycle stream 203 recycled therein can be over 0.9 vol %, or between 0.9 vol % and 4.5 vol % argon (e.g. 0.97-2.5 vol % argon, 1-2.2 vol % argon, or 0.9-2 vol % argon, etc.) via the recycling of the formed argon-enriched recycle stream 203.

The recycled argon-enriched recycle stream 203 can also help provide a content of oxygen that is greater than the content of oxygen within air for the compressed feed stream 103. For example, the content of oxygen within the compressed feed stream 103 that has the argon-enriched recycle stream 203 recycled therein can be over 21 vol %, or between 21 vol % and 25 vol % oxygen (e.g. 21.3-23.8 vol % oxygen, 22-24 vol % oxygen, 21-23 vol % oxygen, etc.) via the recycling of the formed argon-enriched recycle stream 203.

The nitrogen content within the compressed feed stream 103 includes the recycled argon-enriched recycle stream 203 can be lower than a nitrogen content of air. For example, the nitrogen content can be below 78 vol % (e.g. between 72 vol % and 77 vol %, between 70 vol % and 77 vol %, between 75 vol % and 78 vol %, etc.).

Figure 2:
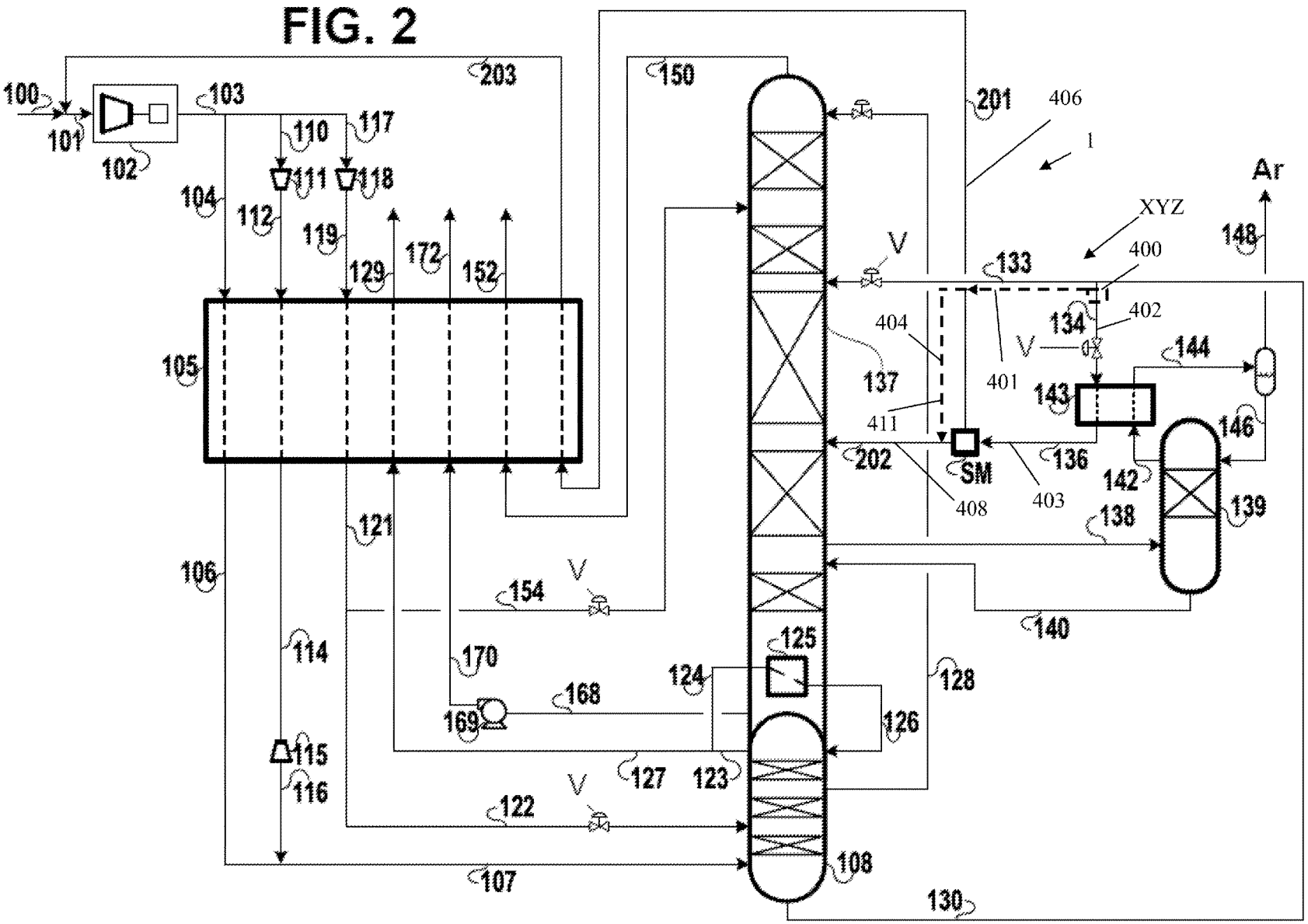
FIG. 2 is a block diagram of a second exemplary embodiment of the apparatus for argon recovery. An exemplary embodiment of a process for argon recovery can also be appreciated from FIG. 2.
Figure 3:
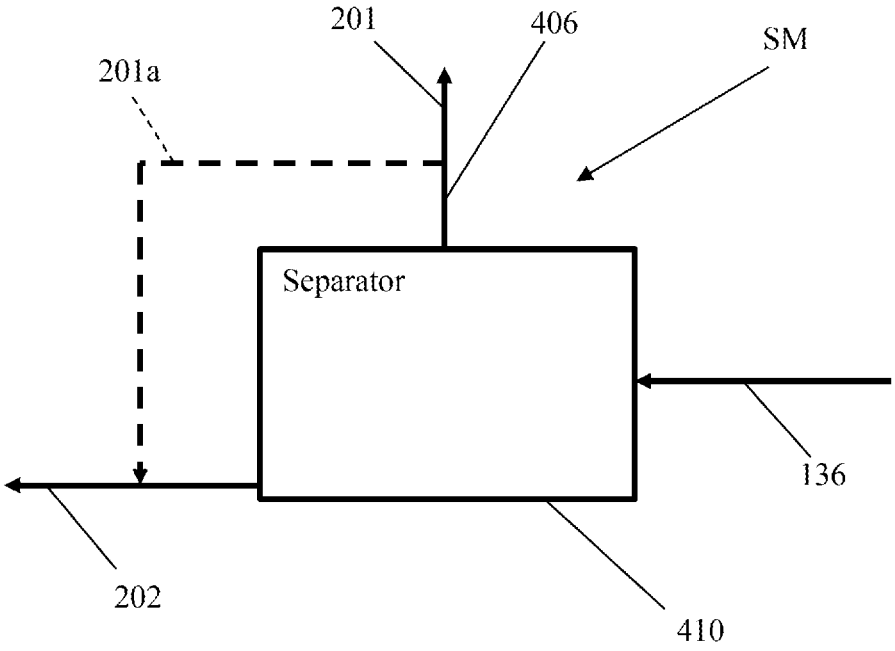
FIG. 3 is a block diagram of an exemplary embodiment of a splitting mechanism (SM) that can be included in the first exemplary embodiment of an apparatus for argon recovery.

The compressed feed gas stream 103 can be fed to the first heat exchanger 105 via at least one heat exchanger feed conduit positioned between the compression system 102 and the first heat exchanger 105. As shown in FIGS. 1-2, in some embodiments the feed gas stream 103 can be split into multiple streams before it is fed to the first heat exchanger 105. At least one valve or other splitting mechanism can be utilized to split the compressed feed gas stream 103 into multiple streams, for example.

In some embodiments, the multiple streams that are formed can include a first feed stream portion 104 and a second feed stream portion 110. In other embodiments, the multiple streams that can be formed can include first feed stream portion 104, a second feed stream portion 110, and a third feed stream portion 117 for feeding to the first heat exchanger 105. In yet other embodiments, the feed gas stream may be split into more than three feed streams instead of two feed streams or three feed streams.

In yet other embodiments, it is contemplated that there may only be a single first feed stream portion 104 such that no second feed stream portion 110 or third feed stream portion 117 is formed. For instance, in some embodiments, the feed gas stream 103 can be fed to the first heat exchanger 105 as a single stream.

In embodiments where the compressed feed gas stream 103 is split or is splittable into two portions, the first feed stream portion 104 can be between 30% and 100% of the entire compressed feed gas stream 103 and the second feed stream portion 110 can be up to 70% of the entire compressed feed gas stream 103 (e.g. greater than 0% to 70% of the feed gas stream 103). In embodiments that may utilize a split of the compressed feed gas stream 3 into three portions, the first feed stream portion 104 can be between 30% and 100% of the entire compressed feed gas stream 103, the second feed stream portion 110 can be up to 70% of the entire compressed feed gas stream 103 (e.g. greater than 0% to 70% of the feed gas stream 103), and the third feed stream portion 117 (when utilized) can be up to 50% of the entire compressed feed gas stream 103 (e.g. greater than 0% to 50% of feed stream 103).

The first heat exchanger 105 can cool the one or more compressed feed gas streams to output the one or more compressed feed gas streams at temperatures within pre-selected temperature ranges for the one or more cooled feed streams. For instance, as can be appreciated from FIGS. 1-2, the compressed feed gas stream 103 can be split into a first feed stream portion 104, a second feed stream portion 110 and/or a third feed stream portion 117. The first feed stream portion 104 can undergo cooling in the first heat exchanger 105 and be subsequently output as a first cooled compressed feed stream 106 for being fed to a first column 108 of a multiple column tower that is upstream of a second column 137 of the multiple column tower.

The second feed stream portion 110 can be fed to a second feed stream compressor 111 to increase its pressure to form a further compressed second feed stream 112 that is subsequently fed to the first heat exchanger 105 to undergo cooling therein. The cooled further compressed second feed stream 114 output from the first heat exchanger 105 can be fed to a first expander 115 so that the second feed stream 116 output from the first expander 115 can be mixed with the first cooled compressed feed stream 106 to form a first column feed stream 107 for feeding that feed stream to the first column 108 of the multiple column tower.

The first column 108 can be a high pressure (HP) column 108 of a multiple column tower that is positioned below or otherwise upstream of the second column 137. The second column 137 can be a low pressure (LP) column of the multiple column tower that can operate at a pressure that is lower than the operational pressure of the HP column 108.

The third feed stream portion 117 (when utilized) can also be compressed via a third feed stream compressor 118 to increase its pressure to form a further compressed third feed stream 119 that is subsequently fed to the first heat exchanger 105 to undergo cooling therein. The cooled further compressed third feed stream 119 can be output from the first heat exchanger 105 as a substantially liquefied third feed stream 121 (e.g. third feed stream 121 is entirely liquid, is between 60 vol % to 100 vol % liquid, is mostly liquid with some vapor mixed therein, is sufficiently liquefied so that the stream has properties of a liquid. etc.). The third feed stream 121 output from the first heat exchanger 105 can be fed to the first column 108 as a second first column feed stream 122, can be fed to the second column 137 as a second column feed stream 154, or can be split to form both streams—a third feed stream 121 output from the first heat exchanger 105 that can be fed to the first column 108 as a second first column feed stream 122 and the second column feed stream 154. In situations where the second first column feed stream 122 is fed to the first column 108, the first column feed stream 107 can be considered a first first column feed stream 107.

In some embodiments or operational cycles utilized during operation of an embodiment, the third feed stream 121 can be split to form the second first column feed stream 122 for feeding to the first column 108 as well as the first second column feed stream 154 for feeding to the second column 137. At least one valve V positioned in the second first column feed stream conduit extending between the first heat exchanger 105 and the first column 108 and at least one valve V positioned in the first second column feed stream conduit extending between the first heat exchanger 105 and the second column 137 can be adjusted to control the splitting of the third feed stream 121. The valves V can also (or alternatively) be controlled to adjust the flow of the third feed stream 121 from the entirety of this stream being fed as the second first column feed stream 122 to the first column 108 to an entirety of the third feed stream 121 being fed as the first second column feed stream 154 for feeding to the second column 137 and vice versa.

In some embodiments, the first column feed stream 107 can be provided so it is at an HP column feeding pressure within a pre-selected HP column feeding pressure range (e.g. 4-30 atm, greater than 5 atm and less than 20 atm, etc.) for feeding the first column feed stream 107 to the first column 108. The cooling via heat exchanger 105 and optional expansion of the second cooled compressed feed stream 114 can be performed so that the first column feed stream 107 is also at a pre-selected HP column feeding temperature that is within a pre-selected HP column feeding temperature range as well as being at a pressure that is within a pre-selected HP column feeding pressure range.

The third feed stream 121 can be formed and compressed to be at the HP feeding pressure within a pre-selected HP feeding pressure range (e.g. 4-100 atm, greater than 5 atm and less than 90 atm, etc. All pressures noted herein are absolute pressures unless stated otherwise.) and also at a pre-selected HP column feeding temperature that is within a pre-selected HP column feeding temperature range for being fed to the first column 108 as the second first column feed stream 122. The third stream 121 can also, or alternatively, be further compressed and cooled via the heat exchanger 105 and third stream compressor 118 to be at a pre-selected feeding pressure range (e.g. 4-100 atm) so as to substantially condense and also at a pre-selected LP column feeding temperature that is within a pre-selected LP column feeding temperature range for being fed to the second column 137 as the first second column feed stream 154 for feeding to the second column 137.

The optional splitting of the initial compressed feed gas stream 103 and compression of the third feed stream portion 117 can be performed to facilitate providing the third feed stream 121 at the desired temperature and pressure for substantially condensing the fluid of that stream and feeding it to the first column 108, second column 137, or being split for feeding different portions to each column based on the cycle of operation and particular parameter needs for operation in that cycle of operation.

The first second column feed stream conduit can include a pressure reduction mechanism (e.g. a valve, expander, etc.) to lower the pressure of the portion of the third feed stream 121 that may be split to feed to the second column 137 so that the pressure of that portion of the stream is within a pre-selected LP pressure range for feeding to the second column 137. It should also be appreciated that in a situation where the entirety of the third stream 121 is to be fed to the second column 137, the third feed stream compressor 118 may not be utilized to further increase the pressure of the third feed stream portion 117.

The first column 108 can be positioned and configured to process the first column feed stream 107 (as well as the as the second first column feed stream 122 when utilized) that can also be fed to the first column 108. As discussed above, in some embodiments or some operational cycles, the first column 108 may only process the first column feed stream 107 (e.g. when the third stream 121 is fed in its entirety to the second column 137 as the first second column feed stream 154 or when no such third stream 121 is formed). In such situations, the first column feed stream 107 may be the only feed stream fed to the first column 108.

The first column 108 can receive the first column feed stream 107 at or adjacent the bottom of the first column 108. The first column 108 can also receive the second first column feed stream 122 (when provided or utilized) at or adjacent the bottom of the first column 108 or at a position that is several stages above the bottom of the first column 108. The first column 108 can operate a pre-selected HP pressure within a pre-selected HP pressure range (e.g. 4 atm to 30 atm, 4.5 atm to 20 atm, 4.5 atm to 10 atm, etc.) and can output a HP nitrogen-rich vapor stream 123 and an HP oxygen-enriched stream 130.

In some embodiments, the first column 108 can also output a first HP nitrogen-enriched LP feed stream 128 for feeding to the second column 137. Such a stream may be utilized in situations where it is desired to provide more nitrogen to the second column 137 to help ensure a sufficient flow of reflux is provided to the second column 137 for separation of argon. In other embodiments, the first column 108 may not output such an HP nitrogen-enriched LP column feed stream 128.

The HP oxygen-enriched stream 130 can be considered a crude liquid oxygen (CLOX) stream that can include liquid oxygen ($O_2$) or a combination of liquid $O_2$ and vapor $O_2$. The CLOX can also include other constituents that includes argon (Ar). For example, the HP oxygen-enriched stream 130 can have an oxygen concentration in a range of 25 vol % to 50 vol %, an argon concentration of 0.5 vol % to 5 vol %, and a nitrogen concentration in the range of 45 vol % to 75 vol % or the HP oxygen-enriched stream 130 can include 30 vol % oxygen to 50 vol % oxygen, 1 vol % argon to 5 vol % argon, and have the balance be nitrogen (e.g. 45 vol % nitrogen to 69 vol % nitrogen).

In embodiments that may utilize the first HP nitrogen-enriched LP column feed stream 128, the first HP nitrogen-enriched LP column feed stream 128 can be comprised of nitrogen (e.g. 100 vol % nitrogen to 90 vol % nitrogen, be almost entirely nitrogen, be between 100 vol % nitrogen and 98 vol % nitrogen, etc.). For example, the first HP nitrogen-enriched stream 128 can include 0 vol % oxygen to 5 vol % oxygen, 1 ppm argon to 3 vol % argon, and have the balance be nitrogen (e.g. be about 100 vol % nitrogen to 92 vol % nitrogen).

The HP nitrogen-rich vapor stream 123 can be a stream that includes gas or vapor that has a nitrogen concentration in the range of 100 vol % nitrogen to 98 vol % nitrogen (e.g. 99 vol % nitrogen, 99.5 vol % nitrogen, etc.). At least a portion of the HP nitrogen-rich vapor stream 123 (e.g. an entirety of the stream or a portion of the stream that is a substantial portion of the stream, etc.) can be fed to a first reboiler-condenser 125 as a first reboiler-condenser feed 124 that is split from the HP nitrogen-rich vapor stream 123. A remaining portion of the HP nitrogen-rich vapor stream 123 can be fed to the first heat exchanger 105 as a nitrogen-rich cooling medium stream 127 to undergo warming in the first heat exchanger 105 and cool the portions of the compressed feed gas stream 103 fed to the first heat exchanger 105. The warmed HP nitrogen-rich vapor stream can be output from the first heat exchanger as a first HP nitrogen-rich vapor product stream 129. This stream can be fed to a plant process that may use the nitrogen stream or otherwise be considered a product stream in some embodiments.

The first reboiler-condenser 125 can be an HP reboiler-condenser 125. The first reboiler-condenser 125 can form an HP condensate stream 126. At least a portion of the HP condensate stream 126 (e.g. an entirety of this stream or less than an entirety of this stream) can be recycled back to the first column 108 as reflux. For instance, at least a portion of the HP condensate stream 126 can be output from the first reboiler-condenser 125 back to the first column 108 as a reflux stream. An entirety of the stream can be provided to the first column as a first portion 426 of this HP condensate stream 126, for example. In other embodiments, the first portion 426 of this HP condensate stream 126 can be provided to the first column 108 and a second portion 428 of the HP condensate stream 126 can be split from the first portion 426 of the HP condensate stream 126 for being fed to the second column 137 as a nitrogen reflux stream to provide additional nitrogen to the second column 137 to facilitate separation of argon from oxygen in the second column 137.

It should be appreciated that the first column 108 can be connected to the second column 137 via an LP column feed conduit through which the first HP nitrogen-enriched LP column feed stream 128 can be fed to the second column 137. The LP column feed conduit through which the first HP nitrogen-enriched LP column feed stream 128 is passable can include a pressure reduction mechanism (e.g. a valve, an expander, other type of pressure reduction mechanism, etc.) to adjust a pressure of the first HP nitrogen-enriched LP column feed stream 128 so it is at a suitable pressure for feeding to the second column 137.

A nitrogen reflux conduit can also be connected between the first reboiler-condenser 125 and the second column 137 so that the second portion 428 of the HP condensate stream 126 is feedable from the first reboiler-condenser 125 to the second column 137. The nitrogen reflux conduit through which the second portion 428 of the HP condensate stream 126 is passable can include a pressure reduction mechanism (e.g. a valve, an expander, other type of pressure reduction mechanism, etc.) to adjust a pressure of this reflux stream so it is at a suitable pressure for feeding to the second column 137.

The second column 137 can be the LP column of the multiple column tower. The second column 137 can operate at a pressure that is below the pressure at which the first column 108 operates. For example, the second column 137 can operate at a pressure of between greater than 1 atm and 4 atm, between 1.1 atm and 3.5 atm, or between 1.1 and 3 atm.

Reflux for the second column 137 can be provided at a top of the LP column, adjacent the top of the LP column 137, or at another position of the LP column via a suitable reflux stream that includes a suitable concentration of nitrogen. The reflux can include the first HP nitrogen-enriched LP column feed stream 128 and/or the second portion 428 of the HP condensate stream 126. For example, some embodiments may only utilize the second portion 428 of the HP condensate stream 126, other embodiments may only utilize the first HP nitrogen-enriched LP column feed stream 128, and yet other embodiments can utilize both the first HP nitrogen-enriched LP column feed stream 128 and the second portion 428 of the HP condensate stream 126. Some embodiments can also be configured so that different operational cycles may utilize one or more of these streams as one or more nitrogen reflux streams based on different operational criteria that may be pre-defined for use of one or more of these streams to provide additional nitrogen reflux to the second column 137 to help facilitate separation of argon from oxygen for forming the argon-enriched stream 138.

The second column 137 can be positioned so that rising vapor or column boil-up for the second column 137 is provided by the first reboiler-condenser 125. Such rising vapor or boil-up can be generated by the first reboiler-condenser 125 and fed to the second column 137 so that this vapor or boil-up flows in counter-current flow with the liquid fed to the second column 137 (e.g. the fluid of the first HP nitrogen-enriched LP column feed stream 128 can include or be liquid that flows downwardly while the vapor or boil-up flows upwardly in the second column 137, the fluid of the second portion 428 of the HP condensate stream 126 can include or be liquid that flows downwardly while the vapor or boil-up flows upwardly in the second column 137, etc.).

The second column 137 can be operated to output multiple flows of fluid during operation. For example, the second column 137 can output an LP argon-enriched stream 138 as well as one or more of a first LP nitrogen-enriched stream 150, a second LP nitrogen-enriched stream 450 and an oxygen-rich stream 168. These streams can each be output from the second column 137 via conduits for feeding those streams to other plant units or devices.

In some embodiments, the LP argon-enriched stream 138 can include 5 vol % to 25 vol % argon, 0 to 1000 ppm nitrogen, and the balance oxygen (about 74.9 vol % oxygen to 95 vol % oxygen). The LP argon-enriched stream 138 can be a flow of fluid that includes vapor. The LP argon-enriched stream 138 can be output from the second column 137 and fed to a third column 139. The third column 139 can be considered an argon enrichment column. The argon enrichment column can also be considered an argon column.

The first LP nitrogen-enriched stream 150 (when utilized) can be a nitrogen-enriched vapor stream that includes nitrogen in a concentration range of 50 vol % to 70 vol %, a range of 70 vol % to 99.9 vol % nitrogen or may be entirely nitrogen (e.g. 100 vol % nitrogen or about 100 vol % nitrogen). The LP nitrogen-enriched stream 150 can be output from the second column 137 and fed to the first heat exchanger 105 for cooling therein to form a nitrogen enriched output stream 152, which can be a nitrogen-rich or nitrogen-enriched product stream or can be a waste stream (e.g. vented to atmosphere, used as a regeneration gas for one or more adsorbers of the purification unit of the compressions system 102, etc.).

The second LP nitrogen-enriched stream 450 (when utilized) can be a nitrogen-enriched vapor stream that includes nitrogen in a concentration range of 50 vol % to 70 vol %, a range of 70 vol % to 99.9 vol % nitrogen, or may be entirely nitrogen (e.g. 100 vol % nitrogen or about 100 vol % nitrogen). The second LP nitrogen-enriched stream 450 can be output from the second column 137 and fed to the first heat exchanger for cooling therein to form a nitrogen-enriched output stream 452, which can be a nitrogen-rich or nitrogen-enriched product stream or can be a waste stream (e.g. vented to atmosphere, used as a regeneration gas for one or more adsorbers of the purification unit of the compressions system 102, etc.). In embodiments that may only utilize the second LP nitrogen-enriched stream 450 (and not the first LP nitrogen-enriched stream 150), the second LP nitrogen-enriched stream 450 can be considered a first LP nitrogen-enriched stream.

The oxygen-rich stream 168 can be an impurities containing stream that includes enriched, but relatively low, concentrations of argon, xenon, krypton, $CO_2$, methane, and/or other hydrocarbons with the balance of the stream being oxygen (e.g. 99 vol % oxygen to 99.99 vol % oxygen, or at least 97 vol % oxygen to 99.99 vol % oxygen). The concentration of the trace impurities within the oxygen-rich stream 168 can depend on a number of factors including the quantity of the flow. In some embodiments, the oxygen-rich stream 168 can include trace amounts of nitrogen, and the balance oxygen (e.g. 97-99.99 vol % oxygen) and be considered an oxygen-rich or oxygen-enriched product stream.

The oxygen-rich stream 168 can be fed to a pump 169 so a compressed oxygen-rich stream 170 can be fed to the first heat exchanger 105 as a cooling medium therein so that it can be warmed therein while cooling the compressed feed gas stream 103. The warmed oxygen-rich stream can be output from the first heat exchanger 105 as an oxygen-enriched product stream 172 or oxygen-rich product stream 172 for subsequent use by another plant process (use as a regeneration gas, directed to another type of device for producing a krypton-enriched product stream and/or a xenon-enriched product stream, etc.). Alternatively, the compressed and warmed oxygen-rich stream 172 can be considered a waste stream and can be output from the heat exchanger 105 as an oxygen-enriched or oxygen-rich waste stream 172 that can be emitted to the atmosphere. In situations where the oxygen-rich stream 168 is to be considered a waste stream or the oxygen-rich stream 168 does not need to undergo an increase in pressure for further use of that stream, the pump 169 may not be utilized to increase the pressure of the stream before it is fed to the first heat exchange 105.

An LP argon-enriched feed conduit can be connected between the second column 137 and the third column 139 for feeding the LP argon-enriched stream 138 to the third column 139 for argon enrichment. For instance, the LP argon-enriched stream 138 can be fed to a lower portion of the third column 139 (e.g. at a bottom of the column or adjacent a bottom of the column). LP argon-enriched stream 138 can be fed to the third column so that the vapor of the LP argon-enriched stream can ascend within the third column 139 to exit the top of the column or exit adjacent the top of the column as an argon-rich vapor stream 142. The argon-rich vapor stream can have a concentration of argon that is higher than the concentration of argon within the LP argon-enriched stream 138 fed to the third column For instance, the argon-rich vapor stream 142 can include 100 vol % to 95 vol % argon (e.g. the argon-rich vapor stream 142 can include 0 vol % to 5 vol % oxygen, 0 vol % to 2 vol % nitrogen, and the balance argon or the argon-rich vapor stream 142 can include 0 vol % to 2 vol % oxygen, 0 vol % to 1 vol % nitrogen, and the balance argon, etc.).

The argon-rich vapor stream 142 can be output from the third column 139 and fed to a second reboiler-condenser 143 via an argon vapor reboiler-condenser feed conduit positioned between the third column 139 and the second reboiler-condenser 143. The second reboiler-condenser 143 can substantially condense the argon-rich vapor of the argon-rich vapor stream 142 to a liquid (e.g. condense an entirety of the argon-rich vapor to a liquid or condense at least 90% of the vapor to a liquid, condense at least 95% of the vapor to a liquid, condense enough of the argon-rich vapor so that it acts as a liquid or the condensed stream output from the second reboiler-condenser has the properties of a liquid, etc.). The substantially condensed or entirely condensed argon-rich stream 144 output from the second reboiler-condenser 143 can be fed to a phase separator that can output an argon vapor product stream 148 that includes argon (Ar) at high concentrations (e.g. 100 vol % Ar to 95 vol % Ar, between 100 vol % Ar and 99 vol % Ar, etc.). A liquid argon reflux stream 146 can be output from the phase separator PS and fed back to the third column 139.

The liquid argon reflux stream 146 can be output from the separator as a fluid portion of argon-rich fluid stream 144 for feeding as reflux to the third column 139 via an argon enrichment column reflux conduit connected between the third column 139 and the phase separator. The third column 139 can receive the liquid argon reflux stream 146 adjacent an upper portion of the third column 139 (e.g. at its top or near its top) so that the liquid argon reflux is passed downwardly through the third column 139 in counter-current flow with the uprising argon vapor of the LP argon-enriched stream 138 fed to the third column 139.

In some embodiments, the condensed argon-rich fluid of the argon-rich vapor stream 142 fed to the second reboiler-condenser 143 can be output from the second reboiler-condenser 143 as an argon-rich fluid stream 144 which is entirely liquid. In such a situation, the phase separator may not be used and the argon product stream 148 can be split off from argon-rich fluid stream 144 and the remaining flow of the argon-rich fluid stream 144 not split off to form the product stream can be used as the liquid argon reflux stream 146.

The third column 139 can also output an argon depleted fluid stream 140 for feeding to the second column 137 via an argon depleted fluid feed conduit connected between the second column 137 and the third column 139. The argon depleted fluid stream 140 can be output at a lower portion of the third column 139 (e.g. at its bottom or adjacent its bottom) for feeding to a location that is below the location at which the LP argon-enriched stream 138 is output from the second column 137 or can be located at a position at or near the position at which the LP argon-enriched stream 138 is output from the second column 137.

The HP oxygen-enriched stream 130 can be routed to the second reboiler-condenser 143. For example, a first portion 134 of the HP oxygen-enriched stream 130 can be fed toward the second reboiler-condenser 143 for providing a duty to condense the argon-rich vapor stream 142. The apparatus 1 can also include a crude oxygen stream processing system XYZ that can be configured to affect this first portion 134 of the HP oxygen-enriched stream 130 before and/or after it is fed to the second reboiler-condenser 143 so that at least one recyclable oxygen-enriched stream is passable upstream of the first, second, and third columns 108, 137, and 139 for being mixed with a feed stream for improving the recovery of argon. The one or more recyclable oxygen-enriched streams can be provided via a crude oxygen stream processing system XYZ. The crude oxygen stream processing system XYZ can be configured to include one or more processing elements or conduit arrangements that can be configured to form or create a recyclable oxygen-enriched stream 201. This oxygen-enriched stream 201 can include a recyclable oxygen-enriched vapor stream 401 that is output from a recyclable oxygen-enriched vapor stream formation device 400 that can be positioned upstream of the second reboiler-condenser 143 for affecting the flow of the first portion 134 of the HP oxygen-enriched stream before it is fed to the second reboiler-condenser 143 and/or an oxygen-enriched first recycle stream 406 (e.g. a portion of this stream or the entirety of this stream) that can be output from a splitting mechanism (SM) that can be positioned downstream of the second reboiler-condenser 143 for affecting the flow of the oxygen-enriched stream after it is output from the second reboiler-condenser 143.

The recyclable oxygen-enriched vapor stream formation device 400 can be configured as a flash device or phase separator in some embodiments. The recyclable oxygen-enriched vapor stream formation device 400 can be configured to flash the first portion 134 of the HP oxygen-enriched stream to reduce the pressure of this stream and form an argon-containing vapor that can be output as a recyclable oxygen-enriched vapor stream 401 and a liquid fraction that can be output as a liquid or predominantly liquid oxygen-enriched stream 402 at a lower pressure for being fed to the second reboiler-condenser 143. The reduction in pressure that can be provided via the vapor stream formation device 400 can be between 0 MPa and 0.9 MPa in some embodiments so that the recyclable oxygen-enriched vapor stream 401 can have a pressure of between 0.1 MPa and 1 MPa and the liquid or predominantly liquid oxygen-enriched stream 402 can have a pressure of between 0.1 MPa and 1 MPa for feeding to the second reboiler-condenser 143.

The splitting mechanism (SM) can be configured as a phase separator or a conduit arrangement in some embodiments. The crude oxygen stream processing system XYZ can include only the splitting mechanism (SM), only the recyclable oxygen-enriched vapor stream formation device 400, or a combination of the splitting mechanism (SM) and the recyclable oxygen-enriched vapor stream formation device 400 in different embodiments.

In some embodiments, or some operational cycles, the HP oxygen-enriched stream 130 can be split so that the first portion 134 of the HP oxygen-enriched stream 130 is fed to the second reboiler-condenser 143 and a second portion 133 of the HP oxygen-enriched stream 130 bypasses the second reboiler-condenser 143 and is feedable to the second column 137. An HP oxygen-enriched stream feed conduit can be connected between the second column 137 and the outlet of the first column that outputs the HP oxygen-enriched stream 130 for feeding the second portion 133 of the HP oxygen-enriched stream 130 to the second column 137. This conduit can include at least one valve V and/or a pressure reduction mechanism (e.g. a valve V, other type of suitable mechanism, etc.) positioned at a location that is prior to where the second portion 133 of the HP oxygen-enriched stream 130 is fed into the second column 137. A valve V of this conduit can also be adjustable between open and closed positions to adjust an extent to which the HP oxygen-enriched stream 130 is split to form the first and second portion 133 and 134 of the HP oxygen-enriched stream 130.

The first portion 134 of the HP oxygen-enriched stream 130 that is fed to the second reboiler-condenser 143 can be fed to the second reboiler-condenser 143 via a second reboiler-condenser oxygen-enriched feed conduit connected between the second reboiler-condenser 143 and the outlet at which the HP oxygen-enriched stream 130 is output from the first column 108. This conduit can also include a valve V that is adjustable between open and closed positions to adjust an extent to which the HP oxygen-enriched stream 130 is split to form the first and second portion 133 and 134 of the HP oxygen-enriched stream 130. The second portion 133 can be less than 50% to 0% of the HP oxygen-enriched stream 130 and the first portion 134 can be between 100% and 50% of the HP oxygen-enriched stream 130 in some embodiments or some operational cycles.

The first portion 134 of the HP oxygen-enriched stream 130 can be fed to the second reboiler-condenser 143 for being warmed therein to a vapor or at least a partially vaporized fluid and provide the cooling medium for condensation of the argon-rich vapor stream 142 fed therein. Prior to being passed into the second reboiler-condenser 143, the first portion 134 of the HP oxygen-enriched stream 130 can undergo pre-processing via a recyclable oxygen-enriched vapor stream formation device 400 that can be positioned upstream of the second reboiler-condenser 143 and downstream of the first column 108.

When used, the recyclable oxygen-enriched vapor stream formation device 400 can also be positioned downstream of where the second portion 133 is split from the first portion 134 of the HP oxygen-enriched stream 130 in some embodiments. In other embodiments, the recyclable oxygen-enriched vapor stream formation device 400 can also be positioned upstream of where the second portion 133 is split from the first portion 134 of the HP oxygen-enriched stream 130. The recyclable oxygen-enriched vapor stream formation device 400 can also be utilized in embodiments or operational cycles where the second portion 133 is not formed.

As may be appreciated from broken line illustrations of FIGS. 1 and 2 as well as FIG. 6-9, the recyclable oxygen-enriched vapor stream formation device 400 can be positioned to vaporize and/or separate gaseous oxygen-enriched vapor from liquid of the first portion 134 of the HP oxygen-enriched stream 130. This first portion 134 can be the entirety of this stream in situations where no second portion 133 of the HP oxygen-enriched stream 130 is formed or in situations where the recyclable oxygen-enriched vapor stream formation device 400 is positioned upstream of where the second portion 133 of the HP oxygen-enriched stream 130 is split from the first portion 134 of the HP oxygen-enriched stream 130.

A liquid or predominantly liquid oxygen-enriched stream 402 of the first portion 134 of the HP oxygen-enriched stream 130 can be output from the recyclable oxygen-enriched vapor stream formation device 400 for being fed to the second reboiler-condenser 143. A recyclable oxygen-enriched vapor stream 401 can be output from the recyclable oxygen-enriched vapor stream formation device 400 for being the oxygen-enriched stream 201 or being a portion of this oxygen-enriched stream 201 that is recycled for being fed upstream of the first, second, and third columns 108, 137, and 139.

In some embodiments, or operational cycles, there can be an excess amount of recyclable oxygen-enriched vapor stream 401 for recycling upstream of the first, second, and third columns 108, 137, and 139. For example, there may be an excessive amount of oxygen-enriched vapor that may be formed such that all the formed recyclable oxygen-enriched vapor is not able to be effectively recycled to the compression system for compression therein. As another example, there may be an excessive amount of formed recyclable oxygen-enriched vapor that is in excess of an amount that can be recycled upstream of the first, second, and third columns for providing a further improvement in argon recovery.

Figure 9:
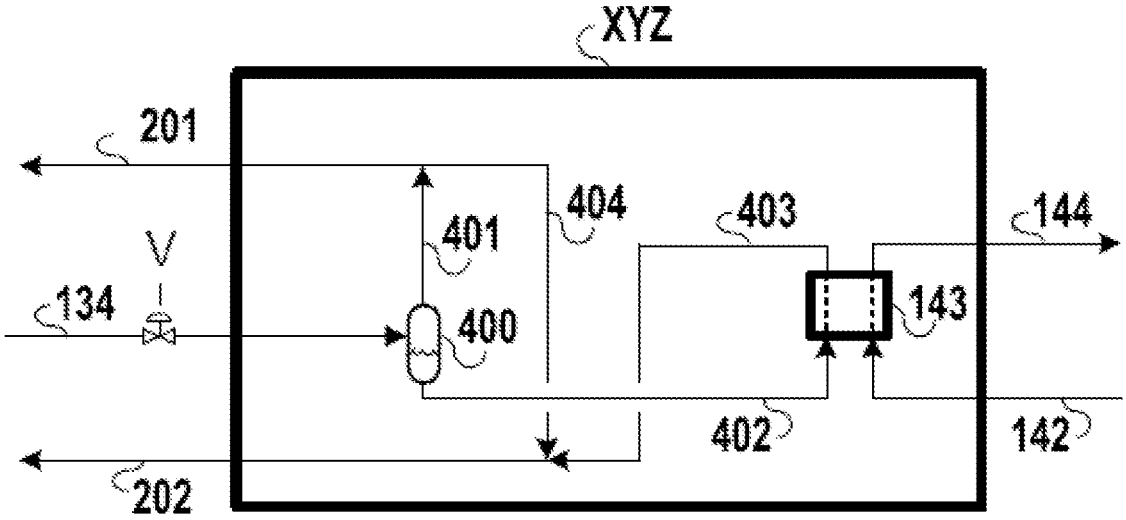
FIG. 9 is a block diagram of a fourth exemplary embodiment of the crude oxygen stream processing system XYZ that can be included in the third and fourth exemplary embodiments of the apparatus for argon recovery.

In some embodiments or operational cycles, an excess portion 404 of the recyclable oxygen-enriched vapor stream 401 can be split from the recyclable oxygen-enriched vapor stream 401 and fed to the second column feed stream 202 for being fed to the second column 137 while a non-excessive portion, or remaining portion of the recyclable oxygen-enriched vapor stream 401 can be included in the oxygen-enriched stream 201 that is to be fed upstream of the first, second, and third columns 108, 137, and 139. FIGS. 1, 2 and 9 may best illustrate embodiments that can provide such functionality, for example.

In other embodiments, no recyclable oxygen-enriched vapor stream formation device 400 may be utilized. FIGS. 1 and 2 may best illustrate such embodiments as the optional recyclable oxygen-enriched vapor stream formation device 400 shown in broken line may not be used or employed in some embodiments or operational cycles.

In some embodiments or operational cycles, the recyclable oxygen-enriched vapor stream 401 can be output from the recyclable oxygen-enriched vapor stream formation device 400 for being mixed with a portion of the recyclable oxygen-enriched stream 136 output from the second reboiler-condenser 143 after that portion has been affected by a splitting mechanism (SM) positioned downstream of the second reboiler-condenser 143.

The first portion 134 of the HP oxygen-enriched stream 130 can be output from the second-reboiler-condenser 143 as a recyclable oxygen-enriched stream 136 so that at least a portion of this oxygen-enriched stream is recyclable to the compression system 102 and/or the fresh feed stream 100 for mixing therewith for forming the feed gas 101 and/or compressed feed gas stream 103.

For instance, the recyclable oxygen-enriched stream 136 can be output from the second reboiler-condenser 143 as a splitting mechanism feed stream 403 for being fed to the splitting mechanism (SM) for recycling at least a portion of this stream to the compression system 102 and/or a position upstream of the compression system 102 for mixing with the fresh feed stream 100 of air and/or industrial process gas (e.g. flue gas and/or other process gas, etc.). The splitting mechanism SM can be a separator, a phase separator, a branched conduit with at least one valve to control a flow split, a combination of these elements, or other suitable equipment for dividing flow so that the recyclable oxygen-enriched stream 136 can be split into a first recycle stream 406 and a second column feed stream 408. In some configurations, the splitting mechanism SM can be considered a type of separation mechanism (e.g. in embodiments that may utilize one or more phase separators).

The second column feed stream 408 can be fed to the second column as an oxygen-enriched second column feed stream 202 or as a portion of the oxygen-enriched second column feed stream 202. At least a portion of the first recycle stream 406 can be recycled upstream of the first column, second column, and third column 108, 137, and 139 as the recyclable oxygen-enriched stream 201 or as a portion of the recyclable oxygen-enriched stream 201. For instance, in some embodiments or operational cycles, the recyclable oxygen-enriched vapor stream 401 that can be output from the recyclable oxygen-enriched vapor stream formation device 400 can be mixed with first recycle stream 406 to from the recyclable oxygen-enriched stream 201. In other embodiments, the recyclable oxygen-enriched vapor stream formation device 400 may not be utilized and at least a portion of the first recycle stream 406 can be recycled upstream of the first column, second column, and third column 108, 137, and 139 as the recyclable oxygen-enriched stream 201 (e.g. an entirety of the first recycle stream 406 can be the recyclable oxygen-enriched stream 201 or a substantial portion of the first recycle stream 406 can be the recyclable oxygen-enriched stream 201, etc.).

In situations where the recyclable oxygen-enriched stream 136 includes two phases of fluid (e.g. is a mixture of vapor and liquid), the splitting of the recyclable oxygen-enriched stream 136 can be performed so that the first recycle stream 406 and the second column feed stream 408 each includes a single phase (e.g. the first recycle stream 406 includes a vapor and the second column feed stream 408 is a liquid) or at least one of these streams is a two phase stream (e.g. the first recycle stream 406 includes a vapor and the second column feed stream 408 is a two-phase stream that includes a mixture of vapor and liquid).

The first recycle stream 406 can be output from the splitting mechanism SM for forming the recyclable oxygen-enriched stream 201 so the recyclable oxygen-enriched stream 201 can be fed to the first heat exchanger 105 to function as a cooling medium therein prior to being output from the first heat exchanger 105 for being fed to the compression system 102 and/or fresh feed stream 100 upstream of the compression system. A recycle conduit can be positioned between the splitting mechanism SM and the compression system 102 to facilitate the recycling of the recyclable oxygen-enriched stream 201 upstream of the first column, second column, and third column 108, 137, and 139 for routing of the recyclable oxygen-enriched stream 201 as the argon-enriched recycle stream 203 in some embodiments.

The recyclable oxygen-enriched stream 201 can be enriched with argon and can include less nitrogen and more argon as well as more oxygen as compared to the fresh air or industrial gas of the fresh feed stream 100 to help increase the argon concentration in the compressed feed stream 103 fed to the column assembly of the ASU for improving the argon recovery obtainable via the third column 139. In some embodiments, the concentration of argon within the compressed feed stream 103 can be over 0.9 vol %, or between 0.9 vol % and 3 vol % argon (e.g. 0.9-2 vol % argon, between 0.9-2.5 vol % argon, etc.) via the recycling of the recyclable oxygen-enriched stream 201 (which can include at least a portion of the first recycle stream 406 and/or at least a portion of the recyclable oxygen-enriched vapor stream 401 in some embodiments).

The content of oxygen can also be greater than the content of oxygen within air for the compressed feed stream 103 via the recyclable oxygen-enriched stream 201. For example, the content of oxygen within the compressed feed stream 103 that has the argon-enriched recycle stream 203 recycled therein can be over 21 vol %, or between 21 vol % and 25 vol % oxygen (e.g. 21.3-23.8 vol % oxygen, 22-24 vol % oxygen, 21-23 vol % oxygen, etc.) via the recycling of the formed argon-enriched recycle stream 203. The nitrogen content within the compressed feed stream 103 includes the recycled argon-enriched recycle stream 203 can be lower than a nitrogen content of air. For example, the nitrogen content can be below 78 vol % (e.g. between 72 vol % and 77 vol %, between 70 vol % and 78 vol %, etc.).

The second column feed stream 408 can be output from the splitting mechanism SM for feeding to the second column 137. The second column feed stream 408 can be passed to the second column 137 as an oxygen-enriched second column feed stream 202 so that this stream is fed adjacent a lower stage of the second column 137 that can be above a location at which the LP argon-enriched stream 138 is output from the second column 137.

Figure 6:
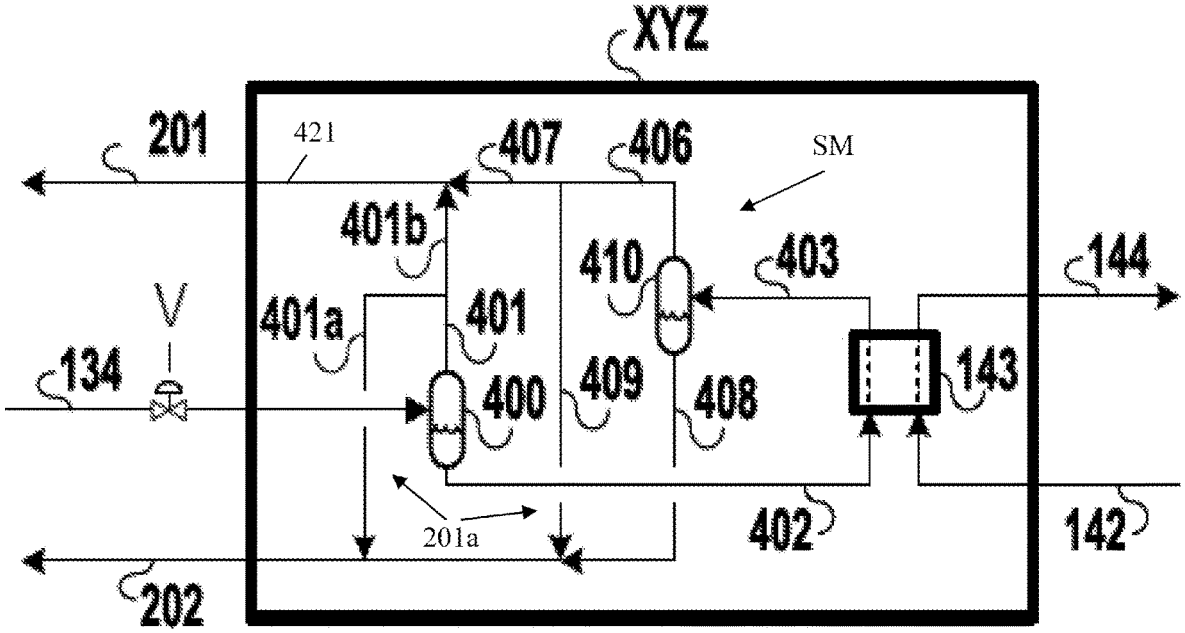
FIG. 6 is a block diagram of a first exemplary embodiment of the crude oxygen stream processing system XYZ that can be included in the third and fourth exemplary embodiments of the apparatus for argon recovery.
Figure 7:
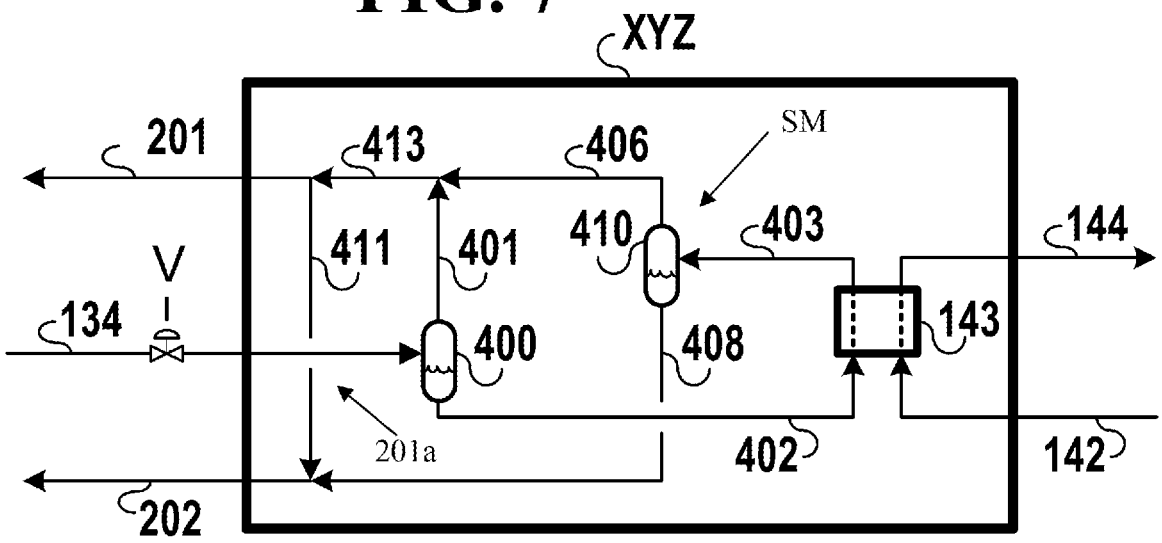
FIG. 7 is a block diagram of a second exemplary embodiment of the crude oxygen stream processing system XYZ that can be included in the third and fourth exemplary embodiments of the apparatus for argon recovery.

In some operational cycles or some embodiments, a portion of the first recycle stream 406 can be split away from recycling upstream of the columns of the ASU and, instead be routed for being fed to the second column feed stream 408 for forming the oxygen-enriched second column feed stream 202 for feeding to the second column 137. For example, in embodiments where the splitting mechanism SM is a phase separator 410 or includes a phase separator 410, it may be desired to feed a portion of the vapor of the first recycle stream 406 to the liquid of the second column feed stream 408 for feeding into the second column 137. Such a split can occur via at least one recycle stream split conduit 201*a*, which can be positioned between the recycle conduit through which the first recycle stream 406 passes and the second column feed conduit through which the second column feed stream 408 can pass. FIGS. 6 and 7 also show exemplary arrangements for at least one recycle stream split conduit 201*a*. In such embodiments where the splitting mechanism SM includes at least one phase separator, the splitting mechanism SM can be considered to be a type of separation mechanism that includes one or more phase separators.

At least one valve can be positioned in one or more of these conduits to facilitate the optional splitting of the first recycle stream 406 so a portion of this stream can be routed to the second column 137. Such splitting, if it occurs, can be between greater than 0 vol % and 30 vol % of the first recycle stream 406 output from the splitting mechanism SM in some embodiments. The argon-enriched recycle stream 203 can be between less than 100 vol % and 70 vol % of the first recycle stream 406 output from the splitting mechanism (SM) in some such embodiments or operational cycles. In other embodiments, such splitting, when it occurs, can be between greater than 0 vol % and 50 vol % of the first recycle stream 406 output from the splitting mechanism (SM). The argon-enriched recycle stream 203 can be between less than 100 vol % and 50 vol % of the first recycle stream 406 output from the splitting mechanism (SM) in such embodiments or operational cycles.

Figure 4:
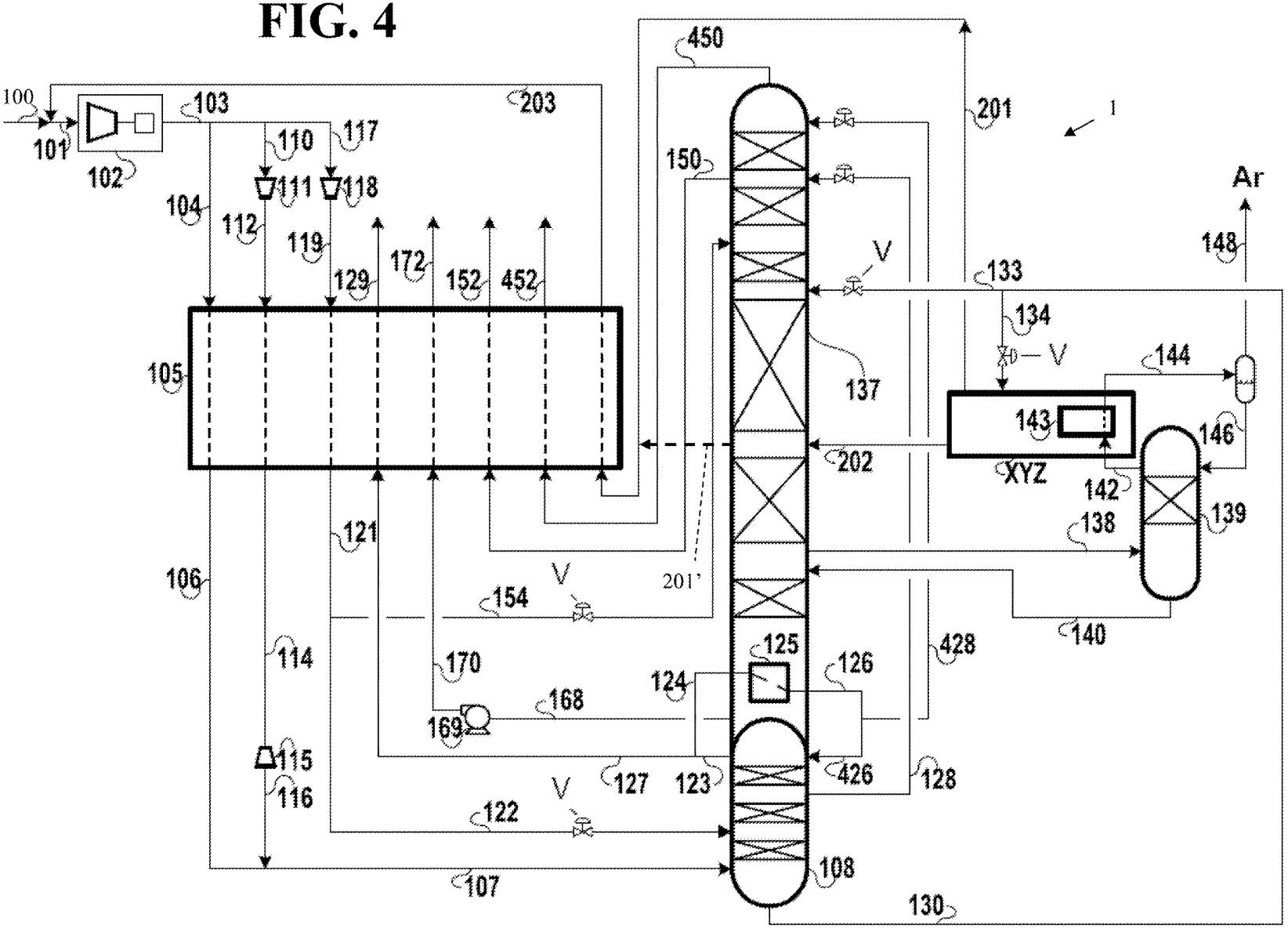
FIG. 4 is a block diagram of a third exemplary embodiment of an apparatus for argon recovery. An exemplary embodiment of a process for argon recovery can also be appreciated from FIG. 4.
Figure 5:
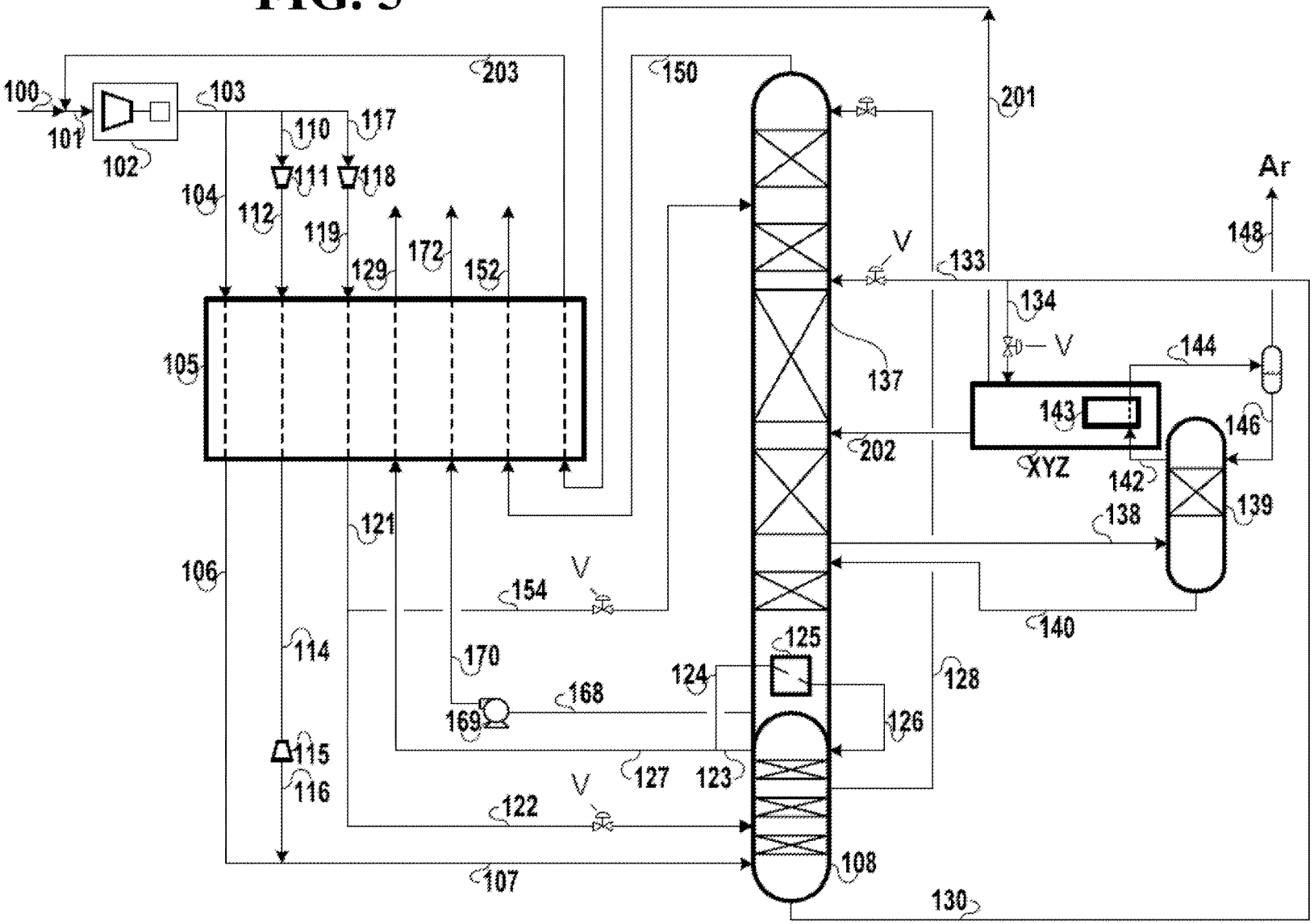
FIG. 5 is a block diagram of a fourth exemplary embodiment of an apparatus for argon recovery. An exemplary embodiment of a process for argon recovery can also be appreciated from FIG. 5.
Figure 8:
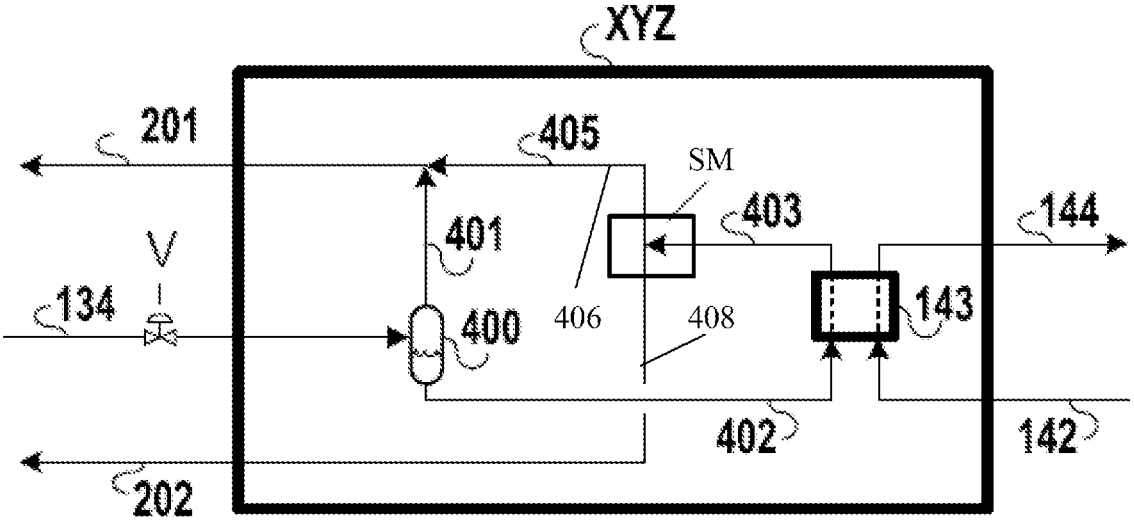
FIG. 8 is a block diagram of a third exemplary embodiment of the crude oxygen stream processing system XYZ that can be included in the third and fourth exemplary embodiments of the apparatus for argon recovery.

As may be best appreciated from the broken line optional elements of FIGS. 1 and 2, the embodiments of FIGS. 4, and 5, as well as the exemplary embodiments of the crude oxygen stream processing system XYZ shown in FIGS. 6, 7, and 8, the first recycle stream 406 and the recyclable oxygen-enriched vapor stream 401 can be routed in various ways for formation of the recyclable oxygen-enriched stream 201.

For example, the first recycle stream 406 output from the splitting mechanism (SM) can be mixed with the recyclable oxygen-enriched vapor stream 401 output from the recyclable oxygen-enriched vapor stream formation device 400 to form a mixed recyclable oxygen-enriched stream 413 that can be provided as the recyclable oxygen-enriched stream 201 for recycling to a position that is upstream of the first, second, and third columns 108, 137, and 139 (see e.g. FIGS. 1, 2, and 8). In some operational cycles or embodiments, a second column split portion 411 can be split from the mixed recyclable oxygen-enriched stream 413 after it is formed for mixing with the second column feed stream 408 for feeding to the second column 137 as the oxygen-enriched second column feed stream 202 (see e.g. FIG. 1, FIG. 2, and FIG. 7). Alternatively, such a split can occur to form the second column split portion 411 and this second column split portion 411 and the second column feed stream 408 can each be fed to the second column 137 separately (e.g. without any pre-mixing).

In yet other configurations, a recyclable portion 401*b* of the recyclable oxygen-enriched vapor stream 401 output from the recyclable oxygen-enriched vapor stream formation device 400 can be output for being fed upstream of the first, second, and third column 108, 137, and 139 as the recyclable oxygen-enriched stream 201 or as a portion of this recyclable oxygen-enriched stream 201. Another portion 401*a* of the recyclable oxygen-enriched vapor stream 401 can be an excess vapor portion that is split for mixing with the second column feed stream 408 for forming of the oxygen-enriched second column feed stream 202. Such a portion 401*a* of the recyclable oxygen-enriched vapor stream 401 can be formed in situations where the formation of the recyclable oxygen-enriched vapor stream 401 output from the recyclable oxygen-enriched vapor stream formation device 400 results in excess gas that cannot all be effectively recycled upstream of the first, second, and third columns 108, 137, 139 for improved argon recovery. In such a situation, the recyclable portion 401*b* of the recyclable oxygen-enriched vapor stream 401 can be considered a first portion of the recyclable oxygen-enriched vapor stream 401 and the other portion 401*a* of the recyclable oxygen-enriched vapor stream 401 can be considered a second portion of the recyclable oxygen-enriched vapor stream 401.

In other operational cycles of embodiments, no recyclable portion 401*b* of the recyclable oxygen-enriched vapor stream 401 may be formed. For instance, in situations where the first recycle stream 406 output from the splitting mechanism SM (e.g. phase separator 410) can provide sufficient vapor for being at least an entirety of the recyclable oxygen-enriched stream 201, no recyclable portion 401*b* of the recyclable oxygen-enriched vapor stream 401 may be formed and an entirety of the recyclable oxygen-enriched vapor stream 401 can be provided as the portion 401*a* of the recyclable oxygen-enriched vapor stream 401 for mixing with the second column feed stream 408 for forming of the oxygen-enriched second column feed stream 202. In such a situation, this portion 401*a* of the recyclable oxygen-enriched vapor stream 401 can be considered a first portion of the recyclable oxygen-enriched vapor stream 401 or an entirety of the recyclable oxygen-enriched vapor stream 401.

As may be appreciated from FIG. 6 (and noted above), the formation of recyclable oxygen-enriched vapor stream 401 output from the recyclable oxygen-enriched vapor stream formation device 400 may not always result in excess vapor. In such operational conditions, at least some of first recycle stream 406 can then be mixed with the recyclable oxygen-enriched vapor stream 401 to form the recyclable oxygen-enriched stream 201 for passing upstream of the first column 108, second column 137, and third column 139 for mixing with the fresh feed stream 100 (e.g. pre-feeding to the compression system or mixing via the compression system, etc.). An excessive portion of the first recycle stream 406 that may be in excess of the gas that can be effectively recycled upstream of the first, second, and third columns 108, 137, 139 for improved argon recovery can be split from the upstream recyclable portion of the first recycle stream 406 as the oxygen-enriched second column feed stream 409 that can be mixed with the second column feed stream 408 for feeding to the second column 137 as an oxygen-enriched second column feed stream 202.

For example, in some operational cycles or some embodiments, the first recycle stream 406 output from the splitting mechanism SM (e.g. a phase separator 410, etc.) can include a recycling portion 407 that is to be used to form or help form the recyclable oxygen-enriched stream 201 that is to be fed upstream of the first, second, and third columns 108, 137, 139 as well as an excess portion that can be split from the recycling portion 407 to form the oxygen-enriched second column feed stream 409 for mixing with second column feed stream 408 for feeding to the second column 137 as an oxygen-enriched second column feed stream 202 or otherwise being provided to the second column as an oxygen-enriched second column feed stream 202.

As another example (and as noted above), the first recycle stream 406 output from the splitting mechanism SM (e.g. a phase separator 410, etc.) can include too much vapor such that only the recyclable portion 401*b* of the recyclable oxygen-enriched vapor stream 401 is used for forming the recyclable oxygen-enriched stream 201. This can be determined via a determination that the desired amount of recyclable oxygen-enriched stream 201 can be entirely provided by a portion of the recyclable oxygen-enriched vapor stream 401 in some embodiments, for instance. In such an operational cycle or embodiment, the entirety of the first recycle stream 406 output from the splitting mechanism SM can be provided as the oxygen-enriched second column feed stream 409 for mixing with second column feed stream 408 for feeding to the second column 137 as an oxygen-enriched second column feed stream 202 or otherwise being provided to the second column as an oxygen-enriched second column feed stream 202.

Figure 10:
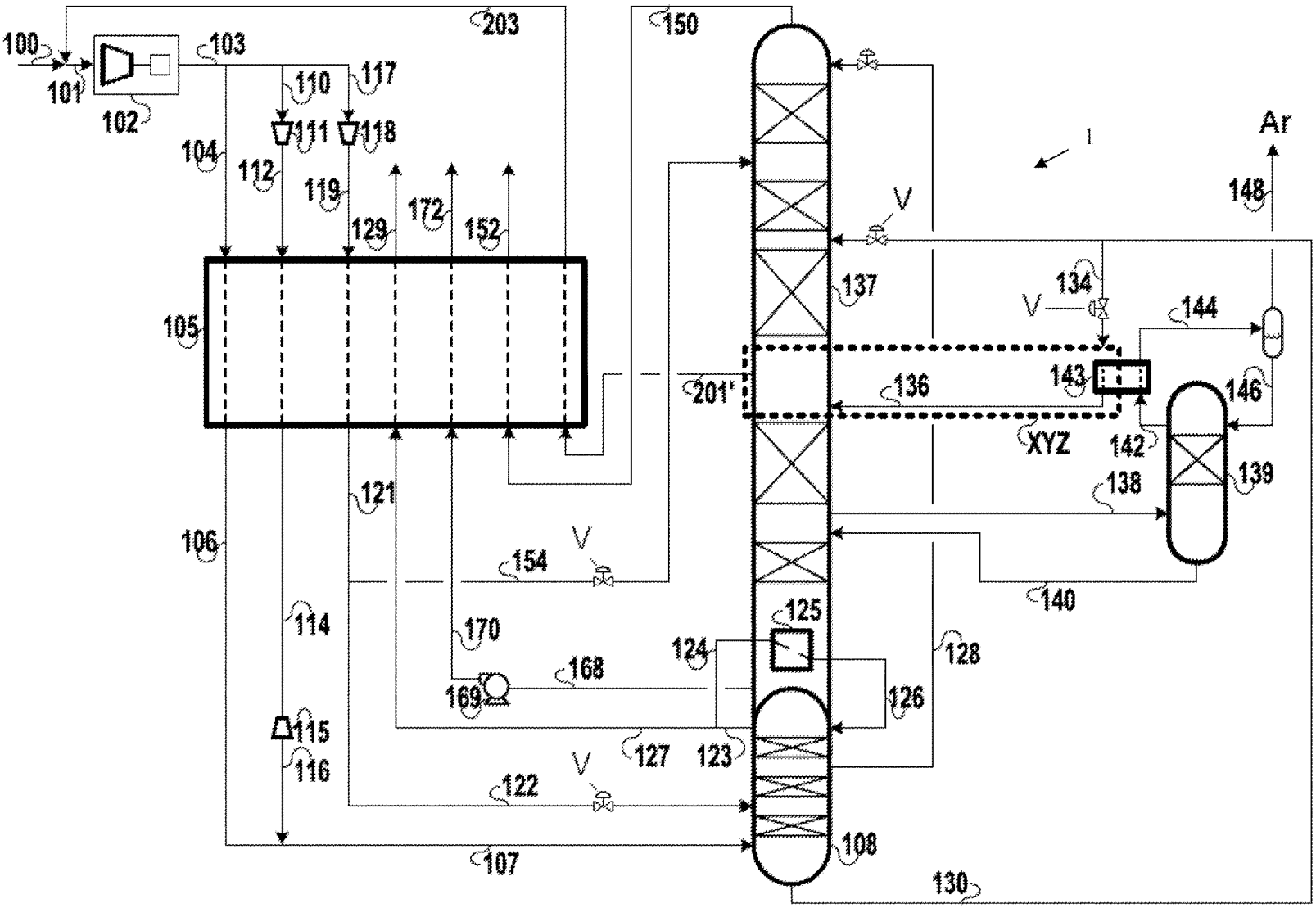
FIG. 10 is a block diagram of a fifth exemplary embodiment of the apparatus for argon recovery. An exemplary embodiment of a process for argon recovery can also be appreciated from FIG. 10.
Figure 11:
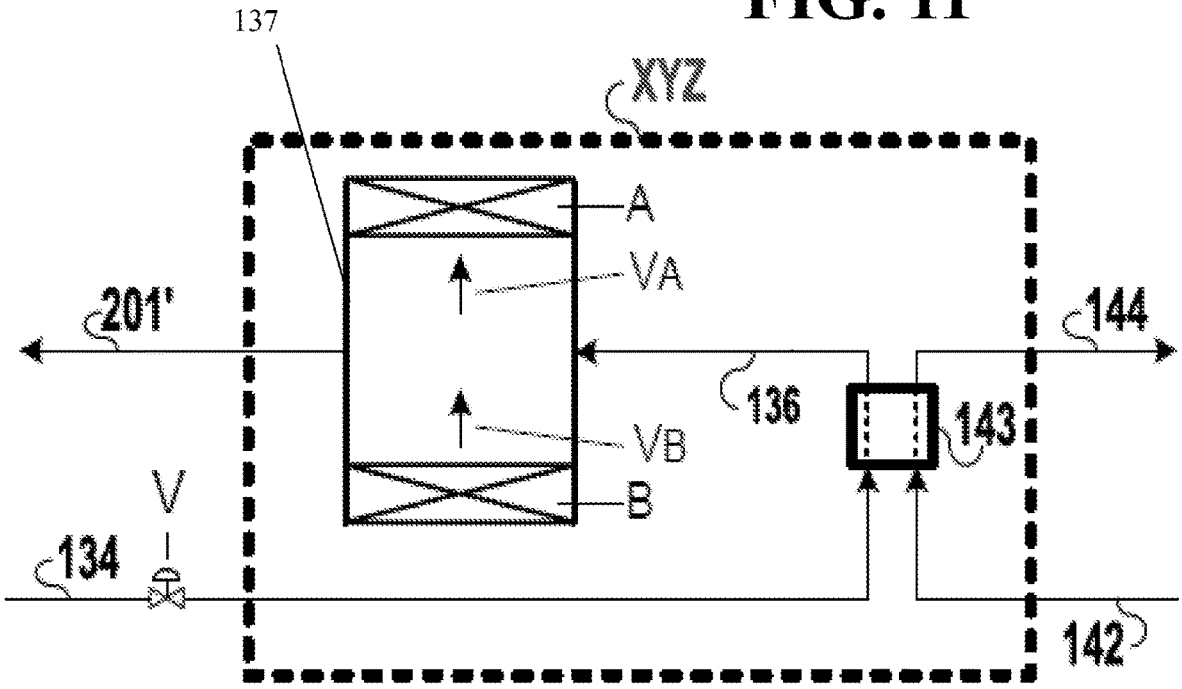
FIG. 11 is a block diagram of an exemplary embodiment of the crude oxygen stream processing system XYZ that can be included in the fifth exemplary embodiment of the apparatus for argon recovery.

In yet other embodiments of the apparatus 1, the crude oxygen stream processing system XYZ can include portions of the second column 137 as indicated in broken line in FIG. 10 and further shown in FIG. 11. For example, the second reboiler-condenser 143 can output the recyclable oxygen-enriched feed stream 136 for feeding to an intermediate portion of the second column 137. The intermediate portion of the second column 137 that receives that stream can be configured to provide a recyclable oxygen-enriched stream 201' for output to the heat exchanger 105 for being warmed therein to form the argon-enriched recycle stream 203 for feeding to the compression system 102 or upstream of the compression system 101 for mixing with the feed stream 100. As may best be seen in FIG. 11, the recyclable oxygen-enriched stream 201' can be output from a location that is at a similar height or location at which the recyclable oxygen-enriched feed stream 136 output from the second reboiler-condenser 143 is fed to the second column 137. In such a situation, the content of the recyclable oxygen-enriched stream 201' may be similar to the argon, oxygen, and nitrogen contents of the vapor component of the recyclable oxygen-enriched feed stream 136, which can have a greater concentration of argon and oxygen as compared to the feed air 100 obtained from ambient air.

In other embodiments, the recyclable oxygen-enriched stream 201' can be output from the second column 137 at a location that is below the location at which the recyclable oxygen-enriched feed stream 136 is fed to the second column. Such a location may be closer to a lower stage B of the second column 137 as compared to the upper stage A that can both be adjacent the location at which the recyclable oxygen-enriched feed stream 136 is fed to the second column 137. In such a location, the content of the recyclable oxygen-enriched stream 201' can be relatively similar in content to vapor $V_B$ ascending from the lower stage B of the second column 137 adjacent to the location at which the recyclable oxygen-enriched stream 201' is output from the second column 137.

In yet other embodiments, the recyclable oxygen-enriched stream 201' can be output from the second column 137 at a location that is above the location at which the recyclable oxygen-enriched feed stream 136 is fed to the second column. Such a location may be closer to an upper stage A of the second column 137 as compared to another stage B that can both be adjacent the location at which the recyclable oxygen-enriched feed stream 136 is fed to the second column 137. In such a location, the content of the recyclable oxygen-enriched stream 201' can be relatively similar in content to vapor $V_A$ being passed into the upper stage A of the second column 137 adjacent to the location at which the recyclable oxygen-enriched stream 201' is output from the second column 137.

The recyclable oxygen-enriched stream 201' can be enriched with argon and can include less nitrogen and more argon as well as more oxygen as compared to the fresh air or industrial gas of the fresh feed stream 100 to help increase the argon concentration in the compressed feed stream 103 fed to the column assembly of the ASU for improving the argon recovery obtainable via the third column 139. In some embodiments, the concentration of argon within the compressed feed stream 103 can be over 0.9 vol %, or between 0.9 vol % and 3 vol % argon (e.g. 0.9-2 vol % argon, between 0.9-2.5 vol % argon, etc.) via the recycling of the recyclable oxygen-enriched stream 201 (which can include at least a portion of the first recycle stream 406 and/or at least a portion of the recyclable oxygen-enriched vapor stream 401 in some embodiments).

The content of oxygen can also be greater than the content of oxygen within air for the compressed feed stream 103 via use of the recyclable oxygen-enriched stream 201'. For example, the content of oxygen within the compressed feed stream 103 that has the recyclable oxygen-enriched stream 201' recycled therein can be over 21 vol %, or between 21 vol % and 25 vol % oxygen (e.g. 21.3-23.8 vol % oxygen, 22-24 vol % oxygen, 21-23 vol % oxygen, etc.) via the recycling of the formed argon-enriched recycle stream 203. The nitrogen content within the compressed feed stream 103 includes the recyclable oxygen-enriched stream 201' can be lower than a nitrogen content of air. For example, the nitrogen content can be below 78 vol % (e.g. between 72 vol % and 77 vol %, between 70 vol % and 78 vol %, between 75 vol % and 78 vol %, etc.).

At least one pressure reduction mechanism (e.g. a valve or other suitable pressure reduction mechanism) can be provided in any of the conduits through which the recyclable oxygen-enriched stream 201 can pass through so that this stream of fluid can undergo a pressure reduction to a suitable pressure for feeding to the compression system 102 and/or mixing with the feed stream 100 upstream of the compression system 102. Also, at least one pressure reduction mechanism (e.g. a valve or other suitable pressure reduction mechanism) can be provided in any of the conduits through which the second column feed stream 202 can pass through so that this stream of fluid can undergo a pressure reduction to a suitable pressure for feeding to the second column 137.

The withdrawing of the recyclable oxygen-enriched stream 201' can be provided as a substitute to use of recyclable oxygen-enriched stream 201 output from another type of splitting mechanism SM and/or crude oxygen stream processing system XYZ. As indicated by broken line in FIGS. 1 and 4, the recyclable oxygen-enriched stream 201' can also be output from the second column 137 for being mixed with the recyclable oxygen-enriched stream 201 output from a splitting mechanism SM and/or crude oxygen stream processing system XYZ for being mixed therein to form the argon-enriched recycle stream 203 or for being fed as a second argon-enriched recycle stream 203 for being mixed with the fresh feed stream 100 upstream of the first, second, and third columns.

The second column feed stream 408 that may be formed for feeding to the second column 137 can be fed entirely to the second column 137 as an oxygen-enriched second column feed stream 202 (e.g. with or without additional oxygen-enriched vapor that may be provided via the excess portion 404 of the recyclable oxygen-enriched vapor stream 401 and/or an excess portion of the first recycle stream 406 output from the splitting mechanism (SM)) so that this stream is fed at a location that is below the location at which the first portion 133 of the HP oxygen-enriched stream 130 is feedable to the second column 137. In other embodiments, these two streams can be mixed together (not shown) prior to being fed to the second column 137.

As noted above, the first HP nitrogen-enriched LP column feed stream 128 as well as the second portion 133 of the HP oxygen-enriched stream 130 and the second portion 428 of the HP condensate stream 126 can all be fed to the second column 137 in some operational cycles or some embodiments. When all such flows are fed to the second column 137, the first HP nitrogen-enriched LP column feed stream 128 can be considered a second column reflux stream and the second portion 428 of the HP condensate stream 126 can also be considered a second column reflux stream. In other embodiments or other operational cycles, none of these streams may be utilized or only one or only two of these streams may be utilized.

The above discussed embodiments of FIGS. 1-2, 4-5, and 10 can utilize a multiple column process that includes the first column 108 configured as an HP column, a second column 137 configured as an LP column, and a third column 139 configured as an argon enrichment column. In some implementations or in some operational cycles, the HP oxygen-enriched stream 130 may not be split and instead, the entirety of this stream may be fed to the second reboiler-condenser 143. In such embodiments or operational cycles, the second-reboiler-condenser oxygen-enriched feed stream can include an entirety of the HP oxygen-enriched stream 130 output from the first column 108 and the recyclable oxygen-enriched feed stream 136 output from the second reboiler-condenser 143 can be considered a first oxygen-enriched feed stream that can be split so at least a portion of this stream is recycled for mixing and compression to form the compressed feed gas stream 103.

FIGS. 2 and 5 illustrate exemplary implementations of the apparatus 1 for improved argon recovery shown in FIGS. 1 and 4. In the implementation of FIGS. 2 and 4, the apparatus 1 can be operated to utilize a subset of some of the optional streams discussed above. For example, the exemplary implementation of FIGS. 2 and 4 do not utilize the second LP nitrogen-enriched stream 450 and does not utilize the second portion 428 of the HP condensate stream 126. Other embodiments may include only one of these streams (e.g. only the second LP nitrogen-enriched stream 450 or only the second portion 428 of the HP condensate stream 126). As discussed above, yet other embodiments may utilize the second portion 428 of the HP condensate stream 126 and not utilize the first HP nitrogen-enriched LP column feed stream 128. Other embodiments may be adapted to a particular set of design criteria for a particular set of operational criteria.

Embodiments of the apparatus 1 can utilize a controller to help monitor and/or control operations of the plant. The plant can be configured as an air separation system or a cryogenic air separation system that is configured as a standalone facility or is incorporated in a larger facility having other plant facilities (e.g. a manufacturing plant for making semiconductor chips, an industrial plant for making goods, a mineral refining facility, etc.).

The apparatus 1, including the embodiments and exemplary implementations of FIGS. 1-11, can be configured as an air separation plant or other type of plant in which it is desired to recover nitrogen and argon from a feed gas; oxygen and argon from a feed gas; nitrogen, argon, and oxygen from a feed gas; or nitrogen, argon, oxygen, as well as krypton, xenon, and/or neon from a feed gas (e.g. air, waste emissions from a plant, etc.).

The apparatus 1 for improved argon recovery can be configured to utilize an air separation process that can be configured to facilitate recovery of at least one argon fluid via an embodiment of the apparatus 1 for argon recovery. The air separation process can also provide for recovering at least one nitrogen fluid flow as well as at least one argon fluid flow. The air separation process can also provide for recovering at least one oxygen fluid flow as well as at least one argon fluid flow. Embodiments can also recover at least three fluids (e.g. at least one oxygen fluid flow, at least one nitrogen fluid flow, and at least one argon fluid flow, or at least one oxygen fluid flow, at least one nitrogen fluid flow, at least one argon fluid flow, at least one xenon flid flow, etc.) as well.

Figure 12:
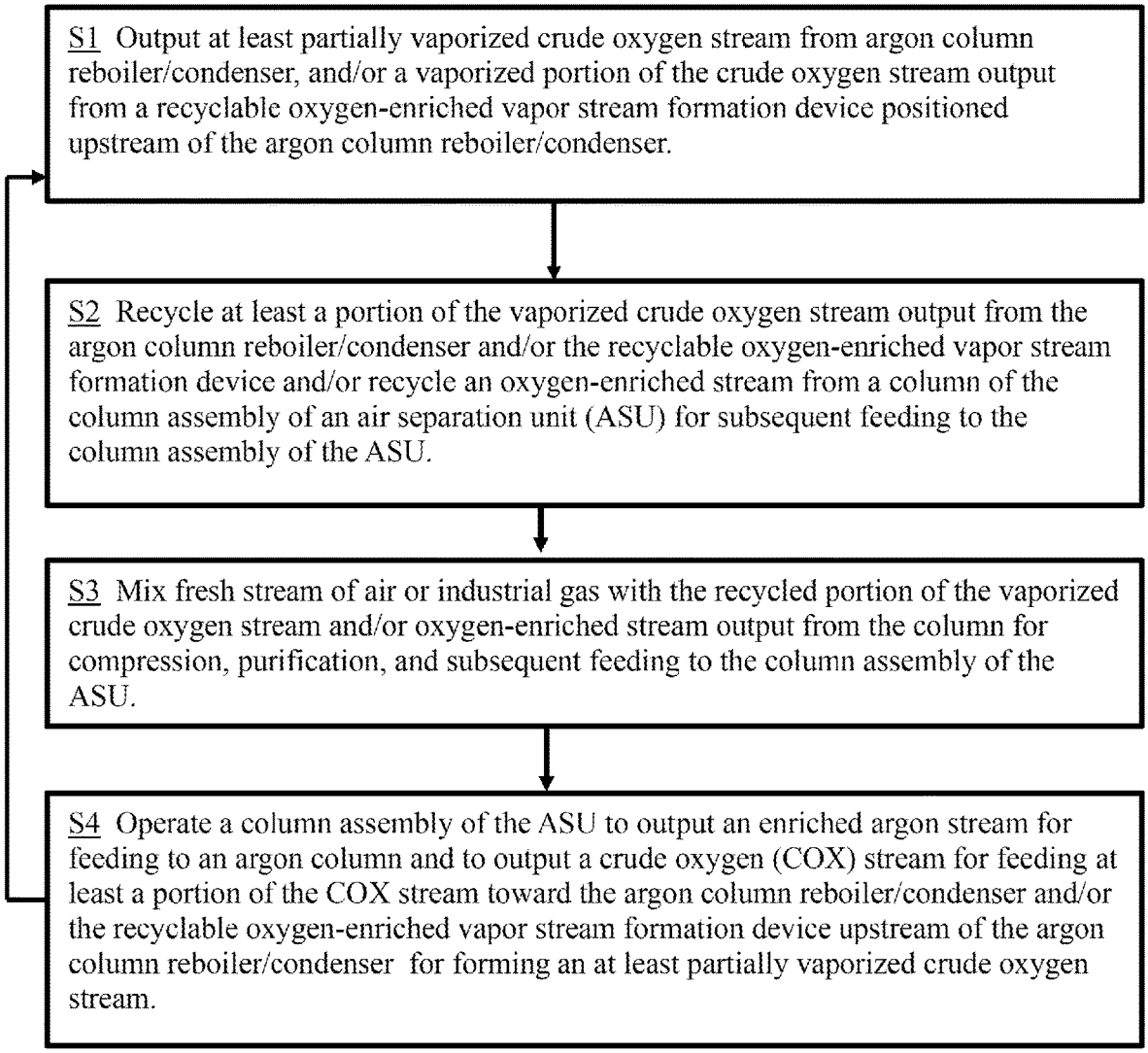
FIG. 12 is a flow chart illustrating an exemplary embodiment of a process for argon recovery. The first, second, third, fourth, and fifth exemplary embodiments of the apparatus for argon recovery can implement this first exemplary embodiment of the process.

An exemplary embodiment of an air separation process that can provide improved argon recovery is shown in FIG. 12. Embodiments of the apparatus 1 can utilize an embodiment of this process. In a first step S1, at least a partially vaporized crude oxygen stream can be output from an argon column reboiler-condenser. Such an outputting can be provided via second reboiler-condenser 143 outputting recyclable oxygen-enriched stream 136, as discussed above, for example.

Also, (or alternatively), the first step S1 can include a vaporized or gaseous portion of the crude oxygen stream output from the first column 108 can be output from a recyclable oxygen-enriched vapor stream formation device 400 positioned upstream of the argon column reboiler-condenser 143. Examples of such processing can be appreciated from the above discussion of how recyclable oxygen-enriched vapor stream 401 that is output from a recyclable oxygen-enriched vapor stream formation device 400 can be utilized in different exemplary embodiments.

Also, (or as yet another alternative), a column of the column assembly of an ASU (e.g. second column 137) can output a recyclable oxygen-enriched stream 201' from an intermediate region of the second column 137 at a location similar to a location at which oxygen-enriched stream 136 output from the second reboiler-condenser is fed to the second column for being recycled to mix with fresh air of a feed stream 100.

In a second step S2, at least a portion of the recyclable oxygen-enriched stream 201 and/or recyclable oxygen-enriched stream 201' that is formed can be recycled for feeding to a column assembly of the ASU. Such recycling can feed at least a portion of the recyclable oxygen-enriched stream 201 or recyclable oxygen-enriched stream 201' that is formed to a position upstream of the columns of the ASU column assembly (e.g. to a position upstream of the first column 108, second column 137, and third column 139 as discussed above for upstream recycling of the argon-enriched recycle stream 203).

In a third step S3, a fresh stream of air or industrial gas can be mixed with the argon-enriched recycle stream 203 for compression, purification, and subsequent feeding to the column assembly of the ASU. Such mixing can be appreciated from the above discussion of how the argon-enriched recycle stream 203 can be mixed with the fresh feed stream 100 via mixing upstream of the compression system 102 or via the compression system 102, for example.

In a fourth step S4, the column assembly of the ASU can be operated to output the enriched argon stream for feeding to an argon column and to also output a crude oxygen (COX) stream for feeding at least a portion of the COX stream to the argon column reboiler-condenser for forming the at least partially vaporized crude oxygen stream. An example of such operation can be appreciated from the above discussion of the first column 108 being operated to output the HP oxygen-enriched stream 130 so at least a portion of this stream is fed to the second reboiler-condenser 143.

Embodiments of the process, apparatus, and system can be adapted for different design criteria. For example, it should be appreciated that other embodiments can utilize different types of conduit arrangements, columns, pumps, heat exchangers, and feeds (e.g. air, flue gas including argon, etc.).

Moreover, embodiments can be provided for retrofitting a pre-existing air separation unit. For instance, a retrofitting method can include providing an arrangement of conduits as well as a splitting mechanism SM that can be provided to accommodate the recycling of the argon-enriched stream output from the second reboiler-condenser 143. The splitting mechanism SM can be positioned as shown in FIG. 1 or 2 during the retrofit operation to facilitate such recycling. Additionally, one or more conduits can be positioned for facilitating the use of the first HP nitrogen-enriched LP column feed stream 128 and/or the second portion 428 of the HP condensate stream 126 in the retrofit operation As yet another option, the retrofit operation can be performed so the splitting mechanism SM includes a conduit to facilitate a splitting of the stream 202 so some vapor is mixed with a liquid stream output from the splitting mechanism for feeding to the second column 137 and a remaining portion of the vapor of stream 202 is recyclable as the argon-enriched recycle stream 203.

Embodiments of the retrofitting can also include providing updated process control elements, an updated automated process control program, or other products or services for installation and subsequent use of an embodiment of the air separation process that can include use of argon-enriched recycle stream 203 for providing improved argon recovery.

As noted above, we have found that embodiments of our apparatus and process can facilitate improved air separation for recovery of argon without incurring a power increase or by only incurring a relatively minor increase in power. The improved argon recovery is also able to be provided via minimal capital costs to provide a significant return on investment in implementation. Embodiments can be adapted to help avoid waste of argon as well as providing improved recovery by facilitating providing sufficient nitrogen reflux to the second column to facilitate separation of oxygen from argon that can account for the higher argon concentration within the feed and the lower nitrogen concentration that may be within the feed due to the recycling of at least a portion of the recyclable oxygen-enriched stream 136.

For example, we have performed simulation work on different embodiments of our apparatus and compared those results to conventional processes. We have surprisingly found that embodiments of the apparatus and process can provide significant power savings for providing improved argon recovery. Some embodiments can reduce power consumption by 1% to 3%, for example. For many commonly sized industrial facilities, this can provide an operational cost savings of over $1 million each year, as well as improved ecological impact by use of less power (e.g. less use of fossil fuels, etc.). In larger sized facilities that may currently be considered less typical, the savings and can be even more significant.

It should also be appreciated that other modifications can also be made to meet a particular set of criteria for different embodiments of the apparatus 1 or process. For instance, the arrangement of valves, piping, and other conduit elements (e.g., conduit connection mechanisms, tubing, seals, valves, etc.) for interconnecting different units of the apparatus for fluid communication of the flows of fluid between different elements (e.g., pumps, compressors, fans, valves, conduits, etc.) can be arranged to meet a particular plant layout design that accounts for available area of the apparatus, sized equipment of the apparatus, and other design considerations. For instance, the size of each column, number of stages each column has, the size and arrangement of each reboiler-condenser, and the size and configuration of any heat exchanger, conduits, expanders, pumps, or compressors can be modified to meet a particular set of design criteria.

As yet another example, some embodiments can utilize enriched vapor stream formation device 400 and phase separator 410 and these mechanisms can be separate phase separators or can be within the same condenser can structure as components of a splitting mechanism SM, which can be configured as a separation mechanism for such embodiments. For example, in some configurations the enriched vapor stream formation device 400 and phase separator 410 can be separate phase separator devices. In other embodiments, each mechanism can be within a common condenser vessel. In some configurations, the common condenser can may also include at least the condenser of the second reboiler-condenser 143 as well.

As another example, the flow rate, pressure, and temperature of the fluid passed through one or more heat exchangers as well as passed through other plant elements can vary to account for different plant design configurations and other design criteria. As yet another example, the number of plant units and how they are arranged can be adjusted to meet a particular set of design criteria. As yet another example, the material composition for the different structural components of the units of the plant and the plant can be any type of suitable materials as may be needed to meet a particular set of design criteria. As yet another example, embodiments can be configured to utilize other techniques known for minimizing the power impact of improved argon recovery, such as subcooling the crude liquid oxygen.

As yet another example, embodiments of the apparatus 1 and process can each be configured to include process control elements positioned and configured to monitor and control operations (e.g., temperature and pressure sensors, flow sensors, an automated process control system having at least one work station that includes a processor, non-transitory memory and at least one transceiver for communications with the sensor elements, valves, and controllers for providing a user interface for an automated process control system that may be run at the work station and/or another computer device of the plant, etc.). It should be appreciated that embodiments can utilize a distributed control system (DCS) for implementation of one or more processes and/or controlling operations of an apparatus or process as well.

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of the process, apparatus, system, and methods of making and using the same have been shown and described above, it is to be distinctly understood that the invention is not limited thereto but may be otherwise variously embodied and practiced within the scope of the following claims.

What is claimed is:

1. A process for separation of a feed gas comprising oxygen, nitrogen, and argon, the process comprising:

outputting an oxygen-enriched stream from a first column of an air separation unit (ASU), the first column operating at a pressure that is greater than a pressure of a second column of the ASU;

(a) passing at least a portion of the oxygen-enriched stream output from the first column through:

(i) a reboiler-condenser of a third column to facilitate condensation of an argon-rich stream outputtable from the third column and outputting of the at least the portion of the oxygen-enriched stream as a recyclable oxygen-enriched stream that is gaseous or is a combination of gas and liquid, and (ii) a recyclable oxygen-enriched vapor stream formation device positioned upstream of the reboiler-condenser of the third column so a vaporized portion of the oxygen-enriched stream output from the first column is output from the recyclable oxygen-enriched vapor stream formation device as a recyclable oxygen-enriched vapor stream that is gaseous; and (b) outputting a recyclable oxygen-enriched stream from the second column; and passing the recyclable oxygen-enriched stream output from the second column, and/or passing at least a portion of the recyclable oxygen-enriched stream output from the reboiler-condenser of the of the third column and/or passing at least a portion of the recyclable oxygen-enriched vapor stream that is gaseous output from the recyclable oxygen-enriched vapor stream formation device upstream of the first column, second column, and third column, for mixing with a feed stream and subsequently being fed to the first column and/or the second column of the ASU.

2. The process of claim 1, comprising:

splitting the recyclable oxygen-enriched vapor stream that is gaseous output from the recyclable oxygen-enriched vapor stream formation device that is upstream of the reboiler-condenser of the third column into a first portion and a second portion so that the first portion of the recyclable oxygen-enriched vapor stream is passable upstream of the first column, second column, and third column, for mixing with the feed stream and subsequently being fed to the first column and/or the second column of the ASU and the second portion of the recyclable oxygen-enriched vapor stream is passable to the second column.

3. The process of claim 1, comprising:

splitting the recyclable oxygen-enriched stream output from the reboiler-condenser of the third column to form (i) a first recycle stream for passing upstream of the first column, second column, and third column, for mixing with the feed stream and (ii) a second column feed stream for feeding to the second column.

4. The process of claim 1, comprising:

compressing the feed stream that includes air and/or industrial gas after the feed stream is mixed with the recyclable oxygen-enriched stream output from the second column, and/or the at least a portion of the recyclable oxygen-enriched stream output from the reboiler-condenser of the of the third column and/or the at least a portion of the recyclable oxygen-enriched vapor stream that is gaseous output from the recyclable oxygen-enriched vapor stream formation device.

5. The process of claim 3, comprising:

passing the second column feed stream to the second column at a location above a location at which an argon-enriched stream is output from the second column for feeding to the third column.

6. The process of claim 3, wherein the splitting is performed via a phase separator.

* * * * *